US011001762B2

(12) United States Patent
Huq et al.

(10) Patent No.: US 11,001,762 B2
(45) Date of Patent: May 11, 2021

(54) PARTIAL UPGRADING OF BITUMEN WITH THERMAL TREATMENT AND SOLVENT DEASPHALTING

(71) Applicant: SUNCOR ENERGY INC., Calgary (CA)

(72) Inventors: Iftikhar Huq, Calgary (CA); Arno De Klerk, Edmonton (CA); Prabhakar Reddy, Calgary (CA)

(73) Assignee: Suncor Energy Inc., Calgary (CA)

( * ) Notice: Subject to any disclaimer, the term of this patent is extended or adjusted under 35 U.S.C. 154(b) by 504 days.

(21) Appl. No.: 15/947,677

(22) Filed: Apr. 6, 2018

(65) Prior Publication Data

US 2018/0298289 A1 Oct. 18, 2018

(30) Foreign Application Priority Data

Apr. 6, 2017 (CA) ..... CA 2963436

(51) Int. Cl.
*C10G 9/00* (2006.01)
*C10G 55/04* (2006.01)
(Continued)

(52) U.S. Cl.
CPC ..... *C10G 9/005* (2013.01); *C10G 1/002* (2013.01); *C10G 1/04* (2013.01); *C10G 21/003* (2013.01);
(Continued)

(58) Field of Classification Search
CPC ..... C10G 9/005; C10G 1/04; C10G 47/00; C10G 1/002; C10G 49/007; C10G 21/003; C10G 67/049; C10G 55/04
See application file for complete search history.

(56) References Cited

U.S. PATENT DOCUMENTS 4,400,264 A 8/1983 Kwant et al.
4,405,441 A 9/1983 Van Dongen et al.
(Continued)

FOREIGN PATENT DOCUMENTS

CA 969497 A 6/1975
CA 996484 A 9/1976
(Continued)

OTHER PUBLICATIONS

Irwin (Process Chemistry of Petroleum Macromolecules, Chemical Industries; 121, Jun. 2008) (Year: 2008).*
(Continued)

*Primary Examiner* — Randy Boyer
*Assistant Examiner* — Juan C Valencia
(74) *Attorney, Agent, or Firm* — BakerHostetler

(57) ABSTRACT

Partial upgrading processes can include thermal treatment combined with solvent deasphalting, and recycling of certain streams, to process bitumen feedstocks and produce a bitumen product. The thermal treatment can be done so that the feedstock is in liquid phase at conditions below incipient coking conditions. Solvent deasphalting can be done before or after thermal treatment depending on the configuration of the process. Subjecting the bitumen feedstock to a partial upgrading can facilitate viscosity reduction of the bitumen feedstock and can facilitate avoiding the need for the addition of an external source of hydrogen.

36 Claims, 14 Drawing Sheets

(51) Int. Cl.

| | |
|---|---|
| ***C10G 1/04*** | (2006.01) |
| ***C10G 47/00*** | (2006.01) |
| ***C10G 1/00*** | (2006.01) |
| ***C10G 49/00*** | (2006.01) |
| ***C10G 21/00*** | (2006.01) |
| ***C10G 67/04*** | (2006.01) |

(52) U.S. Cl.
CPC ..... *C10G 47/00* (2013.01); *C10G 49/007* (2013.01); *C10G 55/04* (2013.01); *C10G 67/049* (2013.01)

(56) References Cited

U.S. PATENT DOCUMENTS

| | | | | |
|---|---|---|---|---|
| 4,454,023 | A * | 6/1984 | Lutz | C10G 67/049 208/106 |
| 4,500,416 | A | 2/1985 | Van Dongen et al. | |
| 4,534,854 | A | 8/1985 | Weinberg et al. | |
| 5,976,361 | A | 11/1999 | Hood et al. | |
| 6,183,627 | B1 | 2/2001 | Friday et al. | |
| 6,702,936 | B2 | 3/2004 | Rettger et al. | |
| 7,297,250 | B2 | 11/2007 | Bronicki | |
| 9,745,527 | B2 | 8/2017 | Morel et al. | |
| 2014/0054199 | A1 | 2/2014 | Koseoglu | |
| 2014/0138287 | A1 | 5/2014 | De Klerk et al. | |

FOREIGN PATENT DOCUMENTS

| | | | | |
|---|---|---|---|---|
| CA | 1118383 | A | 2/1982 | |
| CA | 1130743 | A | 8/1982 | |
| CA | 1132077 | A | 9/1982 | |
| CA | 1153721 | A | 9/1983 | |
| CA | 1196305 | A | 11/1985 | |
| CA | 1296284 | C | 2/1992 | |
| CA | 1296285 | C | 2/1992 | |
| CA | 1304311 | C | 6/1992 | |
| CA | 1310289 | C | 11/1992 | |
| CA | 1314260 | C | 3/1993 | |
| CA | 2025125 | C | 12/1993 | |
| CA | 2012071 | C | 3/1994 | |
| CA | 2118983 | A1 | 10/1994 | |
| CA | 2118984 | A1 | 10/1994 | |
| CA | 2088402 | C | 7/1997 | |
| CA | 2165865 | A1 | 6/1998 | |
| CA | 2002828 | C | 8/1999 | |
| CA | 2080644 | C | 3/2001 | |
| CA | 2244598 | C | 11/2004 | |
| CA | 2566122 | A1 | 12/2005 | |
| CA | 2531262 | A1 | 6/2007 | |
| CA | 2645450 | A1 | 9/2007 | |
| CA | 2549791 | A1 | 11/2007 | |
| CA | 2594104 | A1 | 12/2007 | |
| CA | 2435113 | C | 6/2008 | |
| CA | 2281058 | C | 8/2008 | |
| CA | 2780141 | A1 | 4/2009 | |
| CA | 2274434 | C | 12/2009 | |
| CA | 2549358 | C | 2/2010 | |
| CA | 2332685 | C | 3/2010 | |
| CA | 2530894 | C | 6/2010 | |
| CA | 2324557 | C | 8/2010 | |
| CA | 2657360 | A1 | 9/2010 | |
| CA | 2369288 | C | 5/2011 | |
| CA | 2566761 | C | 6/2011 | |
| CA | 2566788 | C | 6/2011 | |
| CA | 2354734 | C | 7/2011 | |
| CA | 2732919 | A1 | 9/2011 | |
| CA | 2746987 | A1 | 1/2012 | |
| CA | 2753009 | A1 | 4/2012 | |
| CA | 2422534 | C | 5/2012 | |
| CA | 2516562 | C | 5/2012 | |
| CA | 2829291 | A1 | 9/2012 | |
| CA | 2754376 | A1 | 3/2013 | |
| CA | 2867793 | A1 | 10/2013 | |
| CA | 2764676 | C | 11/2013 | |
| CA | 2611251 | C | 1/2014 | |
| CA | 2698133 | C | 1/2014 | |
| CA | 2814773 | C | 8/2014 | |
| CA | 2737872 | A1 | 9/2014 | |
| CA | 2785289 | C | 10/2014 | |
| CA | 2819073 | A1 | 10/2014 | |
| CA | 2848789 | A1 | 10/2014 | |
| CA | 2916767 | A1 | 1/2015 | |
| CA | 2858877 | A1 | 2/2015 | |
| CA | 2743272 | C | 11/2015 | |
| CA | 2592392 | C | 12/2015 | |
| CA | 2953853 | A1 | 1/2016 | |
| CA | 2912768 | A1 | 5/2016 | |
| CA | 2963972 | A1 | 5/2016 | |
| CA | 2897871 | C | 6/2016 | |
| CA | 2773000 | C | 8/2016 | |
| CA | 2897842 | A1 | 1/2017 | |
| CA | 2934741 | A1 | 1/2017 | |
| CA | 2936316 | A1 | 1/2017 | |
| CA | 2952040 | A1 | 6/2017 | |
| CA | 2952068 | A1 | 6/2017 | |
| EP | 0673989 | A2 | 9/1995 | |
| WO | WO-2009002388 | A1 * | 12/2008 | B08B 9/093 |
| WO | 2014180969 | A2 | 5/2014 | |
| WO | 2015000061 | A1 | 1/2015 | |
| WO | 2015021546 | A1 | 2/2015 | |
| WO | 2015065798 | A1 | 5/2015 | |
| WO | 2016000060 | A1 | 1/2016 | |
| WO | 2016081165 | A1 | 5/2016 | |

OTHER PUBLICATIONS

Bianco et al (Thermal cracking of petroleum residues: 3. Technical and economic aspects of hydrogen donor visbreaking), Fuel 1995 vol. 74 No. 5. (Year: 1994).*

Miadonye, A. et al, A correlation for viscosity and solvent mass fraction of bitumen-diluent streams. Petrol. Sci. Technol. 2000, 18, pp. 1-14.

Le Page, J-F. et al., Resid and heavy oil processing, Editions Technip: Paris, 1992.

De Klerk, A. et al., Future Energy, Chapter 5: Unconventional Oil and Gas: Oilsands, 2014, Elsevier Ltd., pp. 95-116.

Lesueur, D., The colloidal structure of bitumen: Consequences on the rheology and on the mechanisms of bitumen modification, Adv. Colloid Interface Sci., 145, p. 42-82, 2009.

Wang, L. et al., Visbreaking oilsands-derived bitumen in the temperature range of 340-400° C, Energy Fuels 2014, 28, p. 5014-5022.

Yañez, L. et al., Visbreaking oilsands bitumen at 300° C, Prepr. Pap.-Am. Chem. Soc., Div. Energy Fuels 2015, 60 (1), p. 31-34.

Niehe, I. A., Process chemistry of petroleum macromolecules, CRC Press: Boca Raton, FL, 2008.

Wiehe, I. A., A solvent-resid phase diagram for tracking resid conversion, Ind. Eng. Chem. Res. 1992, 31, p. 530-536.

Zachariah, A. et al., Upgrading oilsands bitumen: Solvent deasphalting and visbreaking sequence, Prepr. Pap.-Am. Chem. Soc., Div. Energy Fuels 2014, 59 (2), p. 556-557.

Mehrotra, A. K., A generalized viscosity equation for liquid hydrocarbons: Application to oil-sand bitumens, Fluid Phase Equil. 1992, 75, p. 257-268.

Jha, K. N. et al., Chemical composition of gases in Alberta bitumens and in low-temperature thermolysis of oil sand asphaltenes and maltenes. In Oil sand and oil shale chemistry; Strausz, O. P., Lown, E. M. Eds.; Verlag Chemie: New York, 1978, p. 33-54.

Colyar, J., Has the time for partial upgrading of heavy oil and bitumen arrived?, Petrol. Technol. Quarterly 2009, Q4, p. 43-56.

Partial Upgrading Background Review, a White Paper completed in Q1-2016 for Alberta Innovates—Energy and Environment Solutions (AI-EES Contract # 2280).

Ball, M. W., Development of the Athabaska oil sands, Can. Inst. Min. Metall. 1941, 44, p. 58-91.

Wiehe, I. A., Process chemistry of petroleum macromolecules, CRC Press: Boca Raton, FL, 2008.

* cited by examiner

PARTIAL UPGRADING OF BITUMEN WITH THERMAL TREATMENT AND SOLVENT DEASPHALTING

TECHNICAL FIELD

The technical field generally relates to the treatment of bitumen, and more particularly to partial upgrading of bitumen using thermal treatment and/or solvent deasphalting.

BACKGROUND

Bitumen generally has a high viscosity, irrespective of whether it has been recovered by mining operations or by in situ recovery processes. This high viscosity can make the pipeline transportation of bitumen difficult. Various methods exist to decrease bitumen viscosity and increase suitability for pipeline transportation, although such methods have various drawbacks.

For instance, bitumen upgrader facilities of various designs can upgrade the bitumen to produce less viscous products. However, conventional upgrader facilities have high associated capital and operating costs. In addition, in some conventional upgrading methods such as severe thermal cracking, hydrogen originally present in the bitumen is lost to the gas phase such that, in the absence of added hydrogen, significant yet undesirable olefin production can occur. In order to meet pipeline specifications, the olefin content of the bitumen must be minimized, typically to less than 1 wt % (1-decene equivalent). Thus, upgrading methods that produce bitumen products having a high olefin content must therefore use an external source of hydrogen, via some form of hydroprocessing, to provide sufficient hydrogen, i.e. to compensate for at least some of the bitumen hydrogen losses that occurred during cracking, to saturate or convert the olefins by breaking down the carbon-to-carbon double bond and convert them to single bonds, and stabilize cracked products to achieve targeted bitumen quality requirements. Hydroprocessing can include the addition of hydrogen in a separate unit. On the other hand, for economic and technical reasons, various traditional hydroprocessing methods are generally avoided since external hydrogen production has high associated costs. Indeed, any approach using external hydrogen is likely to have higher capital and operating costs.

Another option to improve bitumen viscosity is to dilute the bitumen, for example with naphtha or natural gas condensate as a diluent. Diluted bitumen is often referred to as "dilbit". While bitumen dilution does not have the same capital cost penalty as a bitumen upgrader facility, it still has high associated operating costs. For example, since dilbit includes a significant volume of diluent (e.g., one third diluent and two thirds bitumen per barrel of diluted bitumen), significant pipeline capacity is therefore taken up by the diluent for pipelining of the dilbit as well as the return pipelining of separated diluent to be reused in bitumen dilution. Thus, since diluent travels to and from the bitumen recovery operation, approximately a third of the pipeline capacity can be required for diluent transport and approximately a third of the hydrocarbon inventory can be diluent, which is costly and inefficient.

Other bitumen upgrading methods involve high severity operating conditions and/or significant coking and/or hydrocracking, which can also involve technical challenges as well as high capital and operating costs.

Various challenges exist in terms of technologies for bitumen upgrading and viscosity reduction.

SUMMARY

According to a first aspect, there is provided a process for treating a bitumen feedstock including a liquid phase that includes a heavy fraction, a light fraction and a lighter fraction. The process includes the steps of subjecting the bitumen feedstock to a thermal treatment at about or below incipient coking conditions and without addition of a hydrogen-containing gas. The thermal treatment includes heating the bitumen feedstock at a temperature from about 200° C. to about 475° C. and at a pressure of between about 50 psi and about 1500 psi to produce a thermally treated bitumen stream having an olefin content of less than 5 wt % (1-decene equivalent basis) and including a treated liquid phase and a gas phase. The process further includes separating the gas phase of the thermally treated bitumen stream from the treated liquid phase thereof; and deasphalting the treated liquid phase of the thermally treated bitumen stream or a fraction thereof, including contacting the treated liquid phase with a deasphalting solvent to obtain a partially upgraded bitumen product and an asphaltene-enriched stream. In this process, the gas phase represents less than 5 wt % of the thermally treated bitumen stream, and the thermal treatment is configured such that at least a portion of the lighter fraction is retained in the liquid phase to allow a transfer of hydrogen from the heavy fraction to the light fraction directly in the liquid phase.

According to another aspect, there is provided a process for treating a bitumen feedstock including a liquid phase that includes a heavy fraction, a light fraction and a lighter fraction. The process includes the steps of monitoring the bitumen feedstock, including determining at least one property of the bitumen feedstock; and subjecting the bitumen feedstock to a thermal treatment at predetermined operating conditions, the predetermined operating conditions being adjusted according to the at least one property of the bitumen feedstock and including heating the bitumen feedstock at a temperature from about 200° C. to about 475° C. and at a pressure of between about 50 psi and about 1500 psi to produce a thermally treated bitumen stream including a treated liquid phase and a gas phase, separating the gas phase of the thermally treated bitumen stream from the treated liquid phase thereof; and deasphalting the treated liquid phase of the thermally treated bitumen stream or a fraction thereof, including contacting the treated liquid phase with a deasphalting solvent to obtain a partially upgraded bitumen product and an asphaltene-enriched stream. In this process, the gas phase represents less than 10 wt % of the thermally treated bitumen stream and the thermal treatment is configured such that at least a portion of the lighter fraction is retained in the liquid phase to allow a transfer of hydrogen from the heavy fraction to the light fraction directly in the liquid phase.

In certain implementations, the at least one property of the bitumen feedstock being monitored is a proportion of the heavy fraction, the light fraction and/or the lighter fraction in the bitumen feedstock, a composition characteristic of the bitumen feedstock, a viscosity of the bitumen feedstock and/or a density of the bitumen feedstock.

In this process, the heavy fraction has a boiling point above about 525° C., the light fraction has a boiling point of less than 525° C. and the lighter fraction has a boiling point of less than about 350° C.

Furthermore, in this process, the at least a portion of the lighter fraction being retained in the liquid phase may allow for a transfer of hydrogen from the heavy and/or the light fraction to the lighter fraction directly in the liquid phase.

In some implementations, heating the bitumen feedstock includes heating the bitumen feedstock at a temperature from about 250° C. to about 450° C. In other implementations, the bitumen feedstock is heated at a temperature from about 350° C. to about 450° C. Still in other implementations, the bitumen feedstock is heated at a temperature from about 250° C. to about 425° C. Still in other implementations, the bitumen feedstock is heated at a temperature from about 350° C. to about 425° C.

In this process, the at least a portion of the lighter fraction can be substantially all of the lighter fraction.

Regarding the thermal treatment, this step can be performed for up to about 300 minutes. In other implementations, the thermal treatment is performed for about 30 minutes to about 240 minutes, or for about 60 minutes to about 240 minutes.

In the present process, the gas phase can represent less than 8 wt % of the thermally treated bitumen stream, or less than 6 wt % of the thermally treated bitumen stream, or even less than 3 wt % of the thermally treated bitumen stream. In some implementations, the gas phase includes non-condensable gas.

In some implementations, the bitumen feedstock has an initial viscosity of about from 1 to 100 million cP at ambient temperature.

Regarding the process step of subjecting the bitumen feedstock to the thermal treatment, this step can include adding an external source of hydrogen and/or a hydrogen transfer agent to the bitumen feedstock. The external source of hydrogen can be a hydrogen-containing gas. The hydrogen transfer agent can include paraffins, naphthenes, naphtheno-aromatics and/or aromatics. The hydrogen transfer agent can include butane, propane, methane, tetralin, decalin, and anthracene. The hydrogen transfer agent can also include a hydrogen donor. The hydrogen donor can be a tetralin, decalin, synthetic crude oil, fractions of synthetic crude oil, tight oil, shale oil and/or light crude oils.

In some implementations, the thermally treated bitumen stream includes an olefin content of less than 5.0 wt % (1-decene equivalent). In other implementations, the thermally treated bitumen stream includes an olefin content of less than 1.5 wt % (1-decene equivalent).

In the deasphalting step, the deasphalting solvent can include an alkane-based solvent, for example, propane, butane, pentane, hexane, heptane or a mixture thereof.

In certain implementations, the process for treating the bitumen feedstock further includes processing the asphaltene-enriched stream to produce an asphaltene-derived material. Processing the asphaltene-enriched stream can include recovering a remaining portion of the alkane-based solvent or a remaining portion of the lighter and the light fractions from the asphaltene-enriched stream. Processing the asphaltene-enriched stream can also include subjecting the asphaltene-enriched stream to upgrading processes, such as a thermal upgrading process.

In other implementations, the process for treating the bitumen feedstock further includes diluting the partially upgraded bitumen product with a diluent to obtain a diluted bitumen product. The diluent can include a paraffinic diluent, a naphthenic diluent, natural gas condensates, synthetic crude, a fraction of synthetic crude oil or streams thereof. In some implementations, the diluted bitumen product is diluted to pipeline specifications.

In the present process, the bitumen feedstock can be a diluent-depleted bitumen stream obtained from a bitumen froth treatment operation, and which has not been subjected to distillation or fractionation to remove light hydrocarbon components therefrom. Alternatively, the bitumen feedstock is a bitumen stream that is obtained from an in situ recovery operation and has not been subjected to distillation or fractionation to remove light hydrocarbon components therefrom.

Regarding the thermal treatment, this step can include feeding the liquid phase of the bitumen feedstock to a thermal treatment vessel and heating the liquid phase of the bitumen feedstock therein to produce a thermally treated bitumen stream. In some implementations, the thermal treatment includes withdrawing the thermally treated bitumen stream from the thermal treatment vessel as a single stream from a product outlet, the single stream including the treated liquid phase and the gas phase. The single stream of thermally treated bitumen stream can be fed to a gas separator and at least a portion of the gas phase can be removed from the thermally treated bitumen stream.

In some implementations, deasphalting the treated liquid phase includes feeding at least a portion of the treated liquid phase to a solvent deasphalting unit in fluid communication with a deasphalting solvent supply.

According to another aspect, there is provided a process for treating a bitumen feedstock including a liquid phase that includes a heavy fraction, a light fraction and a lighter fraction. The process includes the steps of monitoring the bitumen feedstock, which includes determining at least one property of the bitumen feedstock, adjusting composition of the bitumen feedstock according to the at least one property of the bitumen feedstock, subjecting the bitumen feedstock to a thermal treatment including heating the bitumen feedstock at a temperature from about 200° C. to about 475° C. and at a pressure of between about 50 psi and about 1500 psi to produce a thermally treated bitumen stream including a treated liquid phase and a gas phase, separating the gas phase of the thermally treated bitumen stream from the treated liquid phase thereof, and deasphalting the treated liquid phase of the thermally treated bitumen stream or a fraction thereof, including contacting the treated liquid phase with a deasphalting solvent to obtain a partially upgraded bitumen product and an asphaltene-enriched stream. In this process, the gas phase represents less than 10 wt % of the thermally treated bitumen stream and the thermal treatment is configured such that at least a portion of the lighter fraction is retained in the liquid phase to allow a transfer of hydrogen from the heavy fraction to the light fraction directly in the liquid phase.

In certain implementations, the at least one property is a proportion of the heavy fraction, the light fraction and/or the lighter fraction in the bitumen feedstock, a composition characteristic of the bitumen feedstock, a viscosity of the bitumen feedstock and/or a density of the bitumen feedstock.

In this process, the heavy fraction has a boiling point above about 525° C., the light fraction has a boiling point of less than 525° C. and the lighter fraction has a boiling point of less than about 350° C.

Furthermore, in this process, the at least a portion of the lighter fraction being retained in the liquid phase allows a transfer of hydrogen from the light fraction to the lighter fraction directly in the liquid phase.

In some implementations, adjusting the composition of the bitumen feedstock includes increasing the proportion of the heavy fraction in the bitumen feedstock to provide available hydrogen to the light fraction. In other implementations, adjusting composition of the bitumen feedstock includes blending multiple bitumen streams having different compositions together. In yet other implementations, adjusting composition of the bitumen feedstock includes modifying operating parameters of upstream processing units producing the bitumen feedstock.

Regarding the process step of heating the bitumen feedstock, this step can be achieved at a temperature from about 250° C. to about 450° C. In some implementations, the bitumen feedstock is heated at a temperature from about 350° C. to about 450° C. In other implementations, the bitumen feedstock is heated at a temperature from about 250° C. to about 425° C. Still in other implementations, the bitumen feedstock is heated at a temperature from about 350° C. to about 425° C.

In some implementations, the at least a portion of the lighter fraction is substantially all of the lighter fraction.

Regarding the thermal treatment, the thermal treatment can be performed for up to about 3000 minutes. In some implementations, the thermal treatment is performed for about 30 minutes to about 240 minutes. In other implementations, the thermal treatment is performed for about 60 minutes to about 240 minutes.

In this process, the bitumen feedstock can have an initial viscosity of about from 1 to 100 million cP at ambient temperature.

The step of subjecting the bitumen feedstock to the thermal treatment can include adding an external source of hydrogen and/or a hydrogen transfer agent to the bitumen feedstock. In some implementations, the external source of hydrogen is a hydrogen-containing gas. In other implementations, the hydrogen transfer agent includes paraffins, naphthenes, naphtheno-aromatics and/or aromatics. The hydrogen transfer agent can be butane, propane, methane, tetralin, decalin, and/or anthracene. The hydrogen transfer agent can also include a hydrogen donor. The hydrogen donor can be tetralin, decalin, synthetic crude oil, fractions of synthetic crude oil, tight oil, shale oil and/or light crude oils.

In some implementations of the present process, the gas phase includes non-condensable gas.

In the present process, the resulting thermally treated bitumen stream can have an olefin content of less than 5.0 wt % equivalent of 1-decene. In other implementations of the process, the resulting thermally treated bitumen stream can have an olefin content of less than 1.5 wt % equivalent of 1-decene.

In the deasphalting step of the present process, the deasphalting solvent can include an alkane-based solvent. The alkane-based solvent can include propane, butane, pentane, hexane, heptane or a mixture thereof.

In certain implementations, the process for treating the bitumen feedstock further includes processing the asphaltene-enriched stream to produce an asphaltene-derived material. Processing of the asphaltene-enriched stream can include recovering a remaining portion of the solvent from the asphaltene-enriched stream. Processing of the asphaltene-enriched stream can also include recovering a remaining portion of the lighter and the light fractions from the asphaltene-enriched stream. Processing of the asphaltene-enriched stream can yet also include subjecting the asphaltene-enriched stream to upgrading processes, such as a thermal upgrading process.

In some implementations, the hydrocarbon stream includes at least a portion of the asphaltene-enriched stream.

The present process for treating the bitumen feedstock can further include diluting the partially upgraded bitumen product with a diluent to obtain a diluted bitumen product. The diluent can include a paraffinic diluent, a naphthenic diluent, natural gas condensates, synthetic crude, a fraction of synthetic crude oil or streams thereof. In some implementations, the diluted bitumen product is diluted to pipeline specifications.

According to another aspect, there is provided a process for treating a hydrocarbon feedstock including a liquid phase that includes a heavy fraction, a light fraction and a lighter fraction. The process includes the step of subjecting the hydrocarbon feedstock to a thermal treatment including heating the hydrocarbon feedstock at a temperature from about 200° C. to about 475° C. and at a pressure of between about 50 psi and about 1500 psi to produce a thermally treated hydrocarbon stream including a liquid phase and a gas phase. In this process, the thermal treatment is configured such that at least a portion of the lighter fraction is retained in the liquid phase to allow a transfer of hydrogen from the heavy fraction to the light fraction directly in the liquid phase.

According to another aspect, there is provided a process for treating a hydrocarbon feedstock including at least a heavy fraction. The process includes the step of subjecting the hydrocarbon feedstock to a thermal treatment including heating the hydrocarbon feedstock at a temperature from about 200° C. to about 475° C. and at a pressure of between about 50 psi and about 1500 psi, a light fraction and a lighter fraction being generated during the thermal treatment, to produce a thermally treated hydrocarbon stream including a liquid phase and a gas phase. In this process, the thermal treatment is configured such that at least a portion of the lighter fraction is retained in the liquid phase to allow a transfer hydrogen from the heavy fraction to the light fraction directly in the liquid phase.

In this process, the heavy fraction has a boiling point above about 525° C., the light fraction has a boiling point of less than 525° C. and the lighter fraction has a boiling point of less than about 350° C.

Furthermore, in this process, the at least a portion of the lighter fraction being retained in the liquid phase can allow for a transfer of hydrogen from the heavy and/or the light fraction to the lighter fraction directly in the liquid phase. The at least a portion of the lighter fraction can be substantially all of the lighter fraction.

The process step of heating the hydrocarbon feedstock can include heating the hydrocarbon feedstock at a temperature from about 200° C. to about 450° C. In some implementations, the bitumen feedstock is heated at a temperature from about 350° C. to about 450° C. In other implementations, the bitumen feedstock is heated at a temperature from about 250° C. to about 425° C. Still in other implementations, the bitumen feedstock is heated at a temperature from about 350° C. to about 425° C.

Regarding the thermal treatment, the thermal treatment can include heating the hydrocarbon feedstock for a duration of up to about 3000 minutes. In some implementations, heating the hydrocarbon feedstock includes heating the hydrocarbon feedstock for a duration of between about 30 minutes and about 240 minutes. In other implementations, heating the hydrocarbon feedstock includes heating the hydrocarbon feedstock for a duration of between about 60 minutes and about 240 minutes.

In the present process, the hydrocarbon feedstock can have an initial viscosity of about from 1 to 100 million cP at ambient temperature.

In this process, the step of heating the hydrocarbon feedstock can include adding an external source of hydrogen and/or a hydrogen transfer agent to the hydrocarbon feedstock. In some implementations, the external source of hydrogen is a hydrogen-containing gas. In some implementations, the hydrogen transfer agent includes paraffins, naphthenes, naphtheno-aromatics and/or aromatics. The hydrogen transfer agent can include butane, propane, methane, tetralin, decalin, and anthracene. The hydrogen transfer agent can also include a hydrogen donor. The hydrogen donor can include tetralin, decalin, synthetic crude oil, fractions of synthetic crude oil, tight oil, shale oil and/or light crude oils.

In some implementations of the present process, the gas phase includes non-condensable gas. In some implementations, the process further includes separating the gas phase of the thermally treated hydrocarbon stream from the liquid phase thereof.

In some implementations, the thermally treated bitumen stream includes an olefin content of less than 5.0 wt % equivalent of 1-decene. In other implementations, the thermally treated bitumen stream includes an olefin content of less than 1.5 wt % equivalent of 1-decene.

In this process, a step of deasphalting the thermally treated hydrocarbon stream can be further included to obtain an asphaltene-enriched stream and an asphaltene-reduced stream. Deasphalting the thermally treated bitumen can include contacting the thermally treated hydrocarbon feedstock with a deasphalting solvent. In some implementations, the deasphalting solvent includes an alkane-based solvent. The alkane-based solvent can include propane, butane, pentane, hexane, heptane or a mixture thereof.

The present process can also further include processing the asphaltene-enriched stream to produce an asphaltene-derived material. Processing the asphaltene-enriched stream can include recovering a remaining portion of the solvent from the asphaltene-enriched stream. Processing the asphaltene-enriched stream can also include subjecting the asphaltene-enriched stream to thermal upgrading.

In some implementations, the hydrocarbon feedstock includes a plurality of hydrocarbon streams mixed together prior to the hydrocarbon feedstock being subjected to the thermal treatment. At least one of the hydrocarbon streams of the plurality of hydrocarbon streams can include at least a portion of the asphaltene-enriched stream.

According to a further aspect, there is provided a system for treating a bitumen feedstock including a liquid phase that includes a heavy fraction, a light fraction and a lighter fraction. The system includes a thermal treatment vessel configured to receive the bitumen feedstock and operable to produce a thermally treated bitumen stream including a liquid phase and a gas phase, and a solvent deasphalting unit configured to receive the thermally treated bitumen stream and operable to produce an asphaltene-enriched stream and an asphaltene-reduced stream. The thermal treatment is configured such that at least a portion of the lighter fraction is retained in the liquid phase to allow a transfer of hydrogen from the heavy fraction to the light fraction directly in the liquid phase.

This system can further include a dilution addition unit configured to receive the asphaltene-reduced stream and operable to dilute the asphaltene-reduced stream with a diluent to produce a diluted bitumen product, and a diluent supply in fluid communication with the diluent addition unit to provide the diluent to the diluent addition unit.

In some implementations, the thermal treatment vessel includes a coil visbreaking unit, a soaker visbreaking unit, a hydrovisbreaker unit, or a thermal chamber. In other implementations, the thermal treatment vessel includes a steam thermal treatment vessel. In yet other implementations, the thermal treatment vessel includes a plurality of thermal treatment vessels arranged in series. The thermal treatment vessel can include a gas fired heater to preheat the bitumen feedstock to a predetermined temperature prior to the bitumen feedstock being fed to the thermal treatment vessel.

In certain implementations, the system further includes a bitumen feedstock control unit upstream of the thermally treated bitumen stream and in fluid communication therewith, the bitumen feedstock control unit being configured to receive the bitumen feedstock and operable to control at least one property of the bitumen feedstock.

In certain implementations, the system further includes a gas separator unit configured to receive the thermally treated bitumen stream thermal treatment vessel and operable to separate the gas phase of the thermally treated bitumen stream from the liquid phase thereof.

In other implementations, the system further includes an asphaltenes processing unit configured to receive the asphaltene-enriched stream to further process the asphaltenes.

According to another aspect, there is provided a system for treating a bitumen feedstock including a liquid phase that includes a heavy fraction, a light fraction and a lighter fraction. The system includes a thermal treatment vessel configured to receive the liquid phase of the bitumen feedstock and operable to produce a thermally treated bitumen stream including a liquid phase and a gas phase. The thermal treatment is configured such that at least a portion of the lighter fraction is retained in the liquid phase to allow a transfer hydrogen from the heavy fraction to the light fraction directly in the liquid phase.

In some implementations, the heavy fraction has a boiling point above about 525° C., the light fraction has a boiling point of less than 525° C. and the lighter fraction has a boiling point of less than about 350° C.

In some implementations, the at least a portion of the lighter fraction being retained in the liquid phase allows a transfer of hydrogen from the light fraction to the lighter fraction directly in the liquid phase.

In some implementations, thermal treatment vessel includes a coil visbreaking unit, a soaker visbreaking unit, a hydrovisbreaker unit, or a thermal chamber. In other implementations, the thermal treatment vessel includes a steam thermal treatment vessel. In yet other implementations, the thermal treatment vessel includes a plurality of thermal treatment vessels arranged in series. The thermal treatment vessel can include a gas fired heater to preheat the bitumen feedstock to a predetermined temperature prior to the bitumen feedstock being fed to the thermal treatment vessel.

The system can further include a bitumen feedstock control unit upstream of the thermal treatment vessel and in fluid communication therewith, the bitumen feedstock control unit being configured to receive the bitumen feedstock and operable to control at least one property of the bitumen feedstock.

The system can also further include a gas separator unit configured to receive the thermally treated bitumen stream and operable to separate the gas phase of the thermally treated bitumen stream from the liquid phase thereof.

The system can also further include a solvent deasphalting unit configured to receive the thermally treated bitumen stream and operable to produce an asphaltene-enriched stream and an asphaltene-reduced stream.

The system can also further include an asphaltenes processing unit configured to receive the asphaltene-enriched stream and operable to further process the asphaltenes and produce an asphaltene-derived material.

The system can also further include a diluent addition unit configured to receive the asphaltene-reduced stream and operable to dilute the deasphalted thermally treated bitumen stream with a diluent to produce a diluted bitumen product.

According to another aspect, there is provided a for treating a bitumen feedstock. The process comprises subjecting the bitumen feedstock to a thermal treatment at about or below incipient coking conditions, the thermal treatment comprising heating the bitumen feedstock at a temperature from about 200° C. to about 475° C. and at a pressure of between about 50 psi and about 1500 psi to produce a thermally treated bitumen; separating the thermally treated bitumen to obtain a thermally treated light fraction and a thermally treated residue fraction; subjecting the thermally treated residue fraction to a solvent deasphalting treatment, comprising contacting the thermally treated residue fraction with a deasphalting solvent to obtain an asphaltene-reduced stream and an asphaltene-enriched stream; and recycling a portion of the asphaltene-reduced stream to form part of the bitumen feedstock that is subjected to the thermal treatment.

In some implementations, the bitumen feedstock comprises a diluent-depleted bitumen stream from a distillation unit, a diluent stripping unit or a diluent recovery unit from which light hydrocarbon components have been removed. In other implementations, the bitumen feedstock comprises a diluent-depleted bitumen stream that is obtained from a bitumen froth treatment operation, and that has not been subjected to distillation or fractionation to remove light hydrocarbon components therefrom. In still other implementations, the bitumen feedstock comprises a bitumen stream that is obtained from an in situ recovery operation and has not been subjected to distillation or fractionation to remove light hydrocarbon components therefrom. In yet other implementations, the bitumen feedstock comprises a bitumen stream that has been subjected to atmospheric distillation and/or vacuum distillation to remove light hydrocarbon components and/or lighter hydrocarbon components therefrom.

In some implementations, the thermal treatment comprises feeding the bitumen feedstock to a thermal treatment vessel and wherein recycling the portion of the asphaltene-reduced stream comprises combining the bitumen feedstock with the recycled portion of the asphaltene-reduced stream and feeding directly into the thermal treatment vessel.

The process can further comprise determining at least one property of the bitumen feedstock. The at least one property is a proportion of various components of the bitumen feedstock, can be a composition characteristic of the bitumen feedstock, a viscosity of the bitumen feedstock and/or a density of the bitumen feedstock.

The process can also further comprise determining at least one property of the asphaltene-reduced stream. The at least one property of the asphaltene-reduced stream can be a composition characteristic of the asphaltene-reduced stream, a viscosity of the asphaltene-reduced stream and/or a density of the asphaltene-reduced stream.

In this process, the proportion of the asphaltene-reduced stream that is recycled can be at least 50% of the asphaltene-reduced stream. The proportion of the asphaltene-reduced stream that is recycled can be determined at least in part based on the at least one property of the bitumen feedstock and/or the at least one property of the asphaltene-reduced stream.

In some implementations, the thermal treatment is performed at an equivalent residence time (ERT) of between approximately 900 s to 1500 s. In some implementations, the thermal treatment can be performed at a temperature between about 350° C. and about 475° C., or between about 450° C. and about 475° C. The thermal treatment can be performed for about 30 minutes to about 240 minutes or for about 60 minutes to about 120 minutes.

Regarding the step of separating the thermally treated bitumen, this step can include one of fractionating, stripping, flashing, distillation, selective adsorption and liquid-liquid extraction to produce the thermally treated light fraction and the thermally treated residue fraction. Separating the thermally treated bitumen can be performed in the thermal treatment vessel, or in a downstream separation vessel distinct from the thermal treatment vessel.

In some implementations, the thermal treatment comprises withdrawing the thermally treated bitumen stream from the thermal treatment vessel as a single stream from a product outlet.

Regarding the process step of subjecting the bitumen feedstock to the thermal treatment, this step can include adding an external source of hydrogen and/or a hydrogen transfer agent to the bitumen feedstock. The external source of hydrogen can be a hydrogen-containing gas. The hydrogen transfer agent can include paraffins, naphthenes, naphtheno-aromatics and/or aromatics. The hydrogen transfer agent can include butane, propane, methane, tetralin, decalin, and anthracene. The hydrogen transfer agent can also include a hydrogen donor. The hydrogen donor can be a tetralin, decalin, synthetic crude oil, fractions of synthetic crude oil, tight oil, shale oil and/or light crude oils. The hydrogen transfer agent can be added to the bitumen feedstock in a proportion of approximately 3 wt. % to 5 wt. %.

In some implementations, no external source of hydrogen and no hydrogen transfer agent is added to the bitumen feedstock during the subjecting the bitumen feedstock to the thermal treatment.

In certain implementations, deasphalting the thermally treated residue fraction comprises feeding the thermally treated residue fraction to a solvent deasphalting unit in fluid communication with a deasphalting solvent supply.

In accordance with another aspect, there is provided a process for treating a bitumen feedstock. The process comprises the steps of subjecting the bitumen feedstock to a solvent deasphalting treatment to produce an asphaltene-reduced stream and an asphaltene-enriched stream; subjecting the asphaltene-reduced stream to a thermal treatment at about or below incipient coking conditions; and recycling a portion of the thermally treated residue stream to form part of the bitumen feedstock that is subjected to the solvent deasphalting treatment. The thermal treatment comprises heating the asphaltene-reduced stream at a temperature from about 200° C. to about 475° C. and at a pressure of between about 50 psi and about 1500 psi to produce a thermally treated asphaltene-reduced stream; and separating the thermally treated asphaltene-reduced stream to obtain a thermally treated light stream and a thermally treated residue stream.

In some implementations, the bitumen feedstock comprises a diluent-depleted bitumen stream from a distillation unit, a diluent stripping unit or a diluent recovery unit from which light hydrocarbon components have been removed therefrom. In other implementations, the bitumen feedstock comprises a diluent-depleted bitumen stream that is obtained from a bitumen froth treatment operation, and that has not been subjected to distillation or fractionation to remove light hydrocarbon components therefrom. In still other implementations, the bitumen feedstock comprises a bitumen stream that is obtained from an in situ recovery operation and has not been subjected to distillation or fractionation to remove light hydrocarbon components therefrom. In yet other implementations, the bitumen feedstock comprises a bitumen stream that has been subjected to atmospheric distillation and/or vacuum distillation to remove light hydrocarbon components and/or lighter hydrocarbon components therefrom.

In the present process, the solvent deasphalting treatment comprises feeding the bitumen feedstock to a solvent deasphalting vessel and recycling the portion of the thermally treated residue stream comprises feeding the thermally treated residue stream directly back into the solvent deasphalting vessel.

In the present process, the thermal treatment comprises feeding the bitumen feedstock to a thermal treatment vessel, and recycling the portion of the thermally treated residue stream comprises feeding the thermally treated residue stream directly back into the thermal treatment vessel.

The process can further comprise monitoring the bitumen feedstock, comprising determining at least one property of the bitumen feedstock. The at least one property can be a proportion of various components of the bitumen feedstock, a composition characteristic of the bitumen feedstock, a viscosity of the bitumen feedstock and/or a density of the bitumen feedstock.

The process can further comprise monitoring the thermally treated residue stream, comprising determining at least one property of the thermally treated residue stream. The at least one property of the thermally treated residue stream can be a composition characteristic of the asphaltene-reduced stream, a viscosity of the asphaltene-reduced stream and/or a density of the thermally treated residue stream.

In some implementations, a proportion of the thermally treated residue stream that is recycled is at least 50% of the thermally treated residue stream. The proportion of the thermally treated residue stream that is recycled can be determined at least in part on the at least one property of the bitumen feedstock and/or the at least one property of the thermally treated residue stream.

In some implementations, the thermal treatment is performed at an equivalent residence time (ERT) of between approximately 900 s to 1500 s. The thermal treatment can be performed at a temperature between about 450° C. and about 475° C., for about 30 minutes to about 240 minutes, or for about 60 minutes to about 240 minutes.

Regarding the step of separating the thermally treated asphaltene-reduced stream, this step can comprise one of fractionating, stripping, flashing, distillation, selective adsorption and liquid-liquid extraction of the thermally treated asphaltene-reduced stream to produce the thermally treated light stream and the thermally treated residue stream.

In certain implementations, separating the thermally treated asphaltene-reduced stream is performed in the thermal treatment vessel. In other implementations, separating the thermally treated asphaltene-reduced stream is performed in a separation vessel distinct from the thermal treatment vessel.

In the present process, the thermal treatment can comprise withdrawing the thermally treated bitumen stream from the thermal treatment vessel as a single stream from a product outlet.

Regarding the process step of subjecting the bitumen feedstock to the thermal treatment, this step can include adding an external source of hydrogen and/or a hydrogen transfer agent to the bitumen feedstock. The external source of hydrogen can be a hydrogen-containing gas. The hydrogen transfer agent can include paraffins, naphthenes, naphtheno-aromatics and/or aromatics. The hydrogen transfer agent can include butane, propane, methane, tetralin, decalin, and anthracene. The hydrogen transfer agent can also include a hydrogen donor. The hydrogen donor can be a tetralin, decalin, synthetic crude oil, fractions of synthetic crude oil, tight oil, shale oil and/or light crude oils.

In some implementations, the hydrogen transfer agent is added to the bitumen feedstock in a proportion of approximately 3 wt % to 10 wt. %.

In other implementations, no external source of hydrogen and no hydrogen transfer agent is added to the bitumen feedstock during the subjecting the bitumen feedstock to the thermal treatment.

In accordance with another aspect, there is provided a process for treating a bitumen feedstock comprising a liquid phase that includes a heavy fraction, a light fraction and a lighter fraction. The process comprising the steps of: subjecting the bitumen feedstock to a solvent deasphalting treatment to produce an asphaltene-reduced stream and an asphaltene-enriched stream; subjecting the asphaltene-reduced stream to a thermal treatment at about or below incipient coking conditions. The thermal treatment comprises heating the asphaltene-reduced stream at a temperature from about 200° C. to about 475° C. and at a pressure of between about 50 psi and about 1500 psi to produce a thermally treated asphaltene-reduced stream having an olefin content of less than 5.0 wt % (1-decene equivalent basis) and comprising a treated liquid phase and a gas phase, the gas phase representing less than 10 wt % of the thermally treated asphaltene-reduced stream; and separating the gas phase of the thermally treated asphaltene-reduced stream from the treated liquid phase thereof.

In some implementations, the bitumen feedstock comprises a diluent-depleted bitumen stream from a distillation unit, a diluent stripping unit or a diluent recovery unit from which light hydrocarbon components have been removed therefrom. In other implementations, the bitumen feedstock comprises a diluent-depleted bitumen stream that is obtained from a bitumen froth treatment operation, and that has not been subjected to distillation or fractionation to remove light hydrocarbon components therefrom. In still other implementations, the bitumen feedstock comprises a bitumen stream that is obtained from an in situ recovery operation and has not been subjected to distillation or fractionation to remove light hydrocarbon components therefrom. In yet other implementations, the bitumen feedstock comprises a bitumen stream that has been subjected to atmospheric distillation and/or vacuum distillation to remove light hydrocarbon components and/or light hydrocarbon components therefrom.

In certain implementations, the thermally treated bitumen stream comprises an olefin content of less than 1.5 wt % equivalent of 1-decene.

The present process can further comprise monitoring the bitumen feedstock, comprising determining at least one property of the bitumen feedstock. The at least one property can a proportion of the heavy fraction, the light fraction and/or the lighter fraction in the bitumen feedstock, a composition characteristic of the bitumen feedstock, a viscosity of the bitumen feedstock and/or a density of the bitumen feedstock.

Subjecting the bitumen feedstock to the solvent deasphalting treatment can comprise feeding the bitumen feedstock to a solvent deasphalting unit in fluid communication with a deasphalting solvent supply, and the deasphalting solvent can comprise an alkane-based solvent. The alkane-based solvent can comprise propane, butane, pentane, hexane, heptane or a mixture thereof.

Regarding the thermal treatment step, this step can comprise feeding the asphaltene-reduced stream to a thermal treatment vessel and heating the asphaltene-reduced stream therein to produce the thermally treated asphaltene-reduced stream. In some implementations, the thermal treatment comprises withdrawing the thermally treated asphaltene-reduced stream from the thermal treatment vessel as a single stream from a product outlet.

In some implementations, separating the gas phase of the thermally treated asphaltene-reduced stream from the treated liquid phase thereof comprises feeding the single stream of thermally treated asphaltene-reduced stream to a gas separator and removing at least a portion of the gas phase from the thermally treated bitumen stream.

In certain implementations, subjecting the asphaltene-reduced stream to the thermal treatment comprises adding an external source of hydrogen and/or a hydrogen transfer agent to the bitumen feedstock. The external source of hydrogen can be a hydrogen-containing gas. The hydrogen transfer agent can include paraffins, naphthenes, naphthenoaromatics and/or aromatics. The hydrogen transfer agent can include butane, propane, methane, tetralin, decalin, and anthracene. The hydrogen transfer agent can also include a hydrogen donor. The hydrogen donor can be a tetralin, decalin, synthetic crude oil, fractions of synthetic crude oil, tight oil, shale oil and/or light crude oils.

In other implementations, no external source of hydrogen and no hydrogen transfer agent is added to the bitumen feedstock during the subjecting the bitumen feedstock to the thermal treatment.

The present process can further comprise diluting the partially upgraded bitumen product with a diluent to obtain a diluted bitumen product. The diluent can comprise a paraffinic diluent, a naphthenic diluent, natural gas condensates, synthetic crude, a fraction of synthetic crude oil or streams thereof.

In some implementations, the diluted bitumen product is diluted to pipeline specifications.

DETAILED DESCRIPTION

Figure 1:
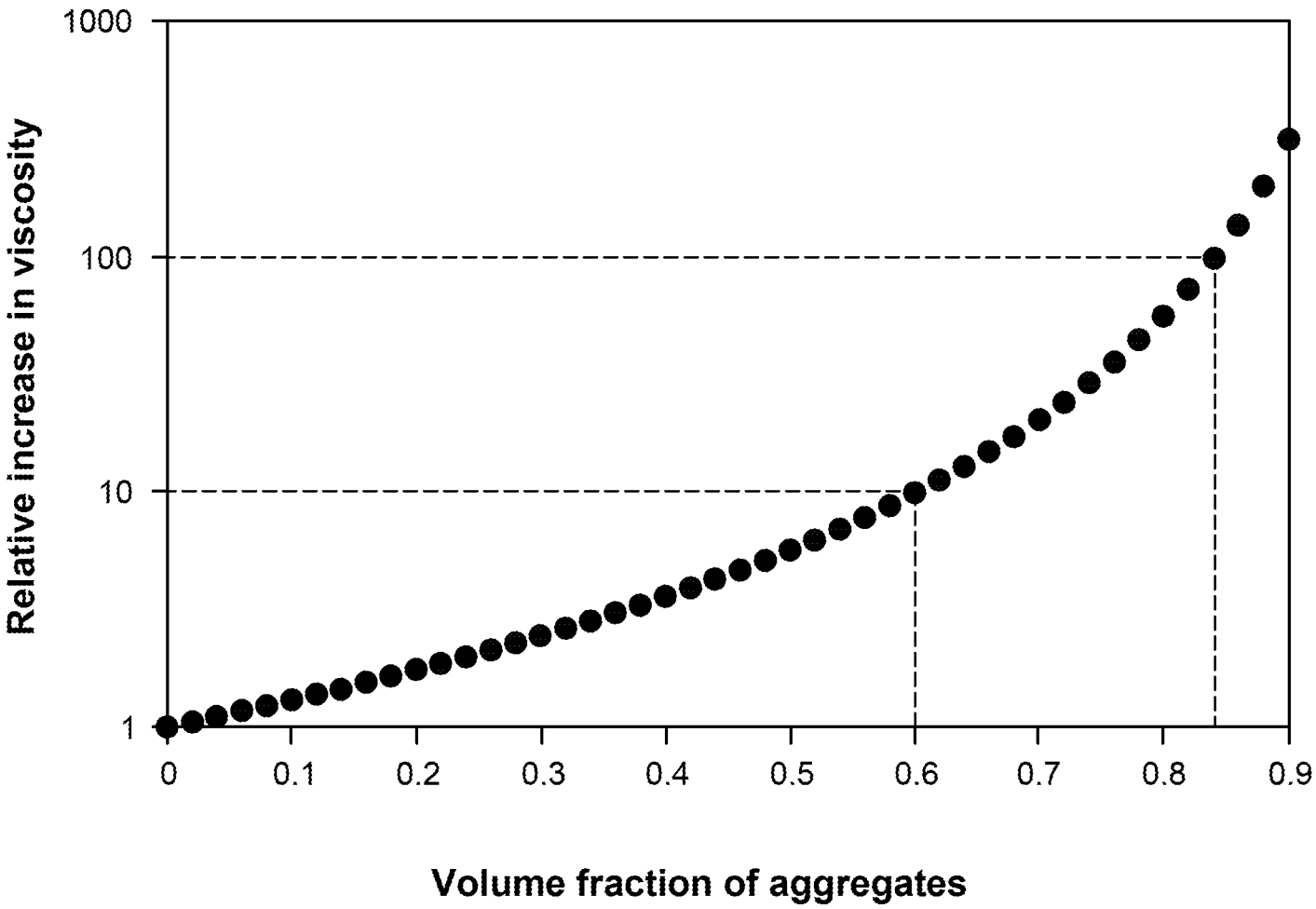
FIG. 1 is a graph depicting a theoretical relationship between a relative increase in viscosity of a bitumen stream versus the volume fraction of aggregates within the bitumen feedstock.

Techniques described herein relate to the treatment of a bitumen feedstock, and can also be referred to as "partial upgrading". The partial upgrading of the bitumen feedstock can include thermally treating the bitumen feedstock, and optionally subjecting the bitumen feedstock to solvent deasphalting. When solvent deasphalting is included as part of the partial upgrading, this step can either be performed prior to or after the thermal treatment. The choice of the sequence, i.e., thermal treatment followed by solvent deasphalting or solvent deasphalting followed by thermal treatment, can depend for instance on the characteristics of the bitumen feedstock, on the desired characteristics of the resulting partially upgraded bitumen product and/or on the overall process configuration and design. In addition, the partial upgrading techniques can be carried out in a single-pass mode or in a recycle mode.

The partial upgrading techniques described herein facilitate viscosity and/or density reduction of the bitumen feedstock. The viscosity and/or density reduction can, in turn, help reduce or eliminate diluent requirements for the bitumen product to be pipelinable. The partial upgrading techniques can also facilitate avoiding the need for the addition of an external source of hydrogen (i.e., hydroprocessing steps) in order to produce a pipelinable bitumen product. For instance, in some implementations, the process facilitates production of a bitumen product having a viscosity of less than 350 centistokes (cSt) measured at 7.5° C., while generating an olefin content of less than 5.0 wt % or less than 1 wt % equivalent of 1-decene. In other implementations, a bitumen product having a viscosity of less than 350 centistokes (cSt) measured at 7.5° C. while generating an olefin content of less than 1.5 wt % or less than 1 wt % equivalent of 1-decene, without the use of added gaseous hydrogen ($H_2$) to saturate the olefins, can be produced. In other implementations, a small amount of external hydrogen and/or a hydrogen transfer agent can be added to the bitumen feedstock during the thermal treatment, as will be described in more detail below.

The bitumen feedstock can be a solvent-reduced bitumen feedstock, for instance from a bitumen froth treatment, that has not been subjected to fractionation or distillation to remove light hydrocarbons such as gas oil. The bitumen feedstock can thus include a heavy hydrocarbon fraction including asphaltenes, a light hydrocarbon fraction including gas oil, and a lighter hydrocarbon fraction including more volatile hydrocarbon components. The bitumen feedstock can also be obtained from a diluent recovery unit, a diluent stripping unit or a distillation unit, for instance that has received a diluted bitumen stream from an in situ recovery facility or a secondary extraction operation.

The thermal treatment can be a low-intensity thermal treatment under temperature and pressure conditions below and/or close to incipient coking conditions, while substantially maintaining the bitumen feedstock components in liquid phase to enable hydrogen transfer to occur from the heavy hydrocarbon fraction to the light hydrocarbon fraction. The bitumen product of the low-intensity thermal treatment can be removed as a single stream that includes all of the hydrocarbon components, thus forming the thermally treated bitumen stream. In some implementations, the single stream of thermally treated bitumen can then be subjected to separation steps to produce various streams, such as one or more light fractions and one or more heavy fractions. The light fractions can include naphtha, distillate, and/or gasoil, and the heavy fraction can include material having a boiling point above 525° C. It should be noted that the separation of the thermally treated stream can be performed using multiple separation units arranged in series so that downstream separation units receive one of the output streams of an upstream unit. More regarding the separation of the thermally treatment stream will be discussed further below.

The low-intensity thermal treatment is also conducted such that a low quantity of non-condensable hydrocarbon gas is generated. Thus, the thermally treated bitumen stream can be a substantially liquid-phase stream with a minor amount of non-condensable gas (e.g., less than 5 wt %), which can be removed prior to subsequent processing. In some implementations, the thermally treated bitumen stream can then be subjected to solvent deasphalting to produce an asphaltene stream and a partially upgraded bitumen product having reduced viscosity, reduced asphaltene content and higher quality compared to the bitumen feedstock.

During the low-intensity thermal treatment, both the heavy and light hydrocarbon fractions undergo various reactions, including thermal cracking. The thermal treatment conditions described herein are provided to avoid or substantially inhibit conversion of heavy hydrocarbon components into coke, although some coke precursors can form. The cracking reactions result in the formation of smaller hydrocarbon molecules, which have a positive impact on viscosity reduction and bitumen product quality.

The low-intensity thermal treatment of a bitumen feedstock that includes both a heavy and a light hydrocarbon fractions maintained in liquid phase as described herein facilitates leveraging the hydrogen content of the heavy hydrocarbon fraction by enabling efficient hydrogen transfer from the heavy hydrocarbon fraction to the light hydrocarbon fraction, contributing to the enrichment of the light hydrocarbon fraction with hydrogen, which has a positive impact on viscosity reduction and bitumen product quality. Thus, components of the heavy hydrocarbon fraction become depleted in hydrogen due to the hydrogen transfer to lighter components. A thermally treated bitumen stream is therefore produced that includes a hydrogen-depleted heavy hydrocarbon fraction and a hydrogen-enriched light hydrocarbon fraction.

Hence, the thermal treatment techniques described herein facilitate viscosity reduction of a bitumen feedstock while avoiding substantial olefin production at efficient operating conditions. In addition, as both heavy and light hydrocarbons play a role in the thermal treatment of the liquid phase of the bitumen feedstock, the step of distillation conventionally performed to remove light hydrocarbons prior to upgrading the residuum fraction (i.e., bottom fraction of distillation) is not required. The efficient production of a bitumen product having such low-viscosity and low-olefin characteristics is enabled, at least in part, by using operating conditions that allow liquid-phase transfer of hydrogen from the heavy hydrocarbon fraction to the light fraction during thermal cracking and hence avoiding the rejection of hydrogen with a gas phase, followed by the removal of the hydrogen-depleted heavy components. In addition, the partial upgrading techniques enable increasing the hydrogen-to-carbon ratio of the bitumen product, which can further increase product quality and value.

Alternatively, the low-intensity thermal treatment described herein may be performed on a hydrocarbon feedstock that comprises at least a heavy fraction (e.g., asphaltenes). In such an example, the light fraction and lighter fraction are rather produced, at least in part, in situ during thermal treatment of the feedstock, the heavy, light and lighter fractions then undergoing the same reaction and transfer of hydrogen as described above. In other implementations, an external source of a fraction light and/or a lighter fraction can be added to a hydrocarbon feedstock that comprises at least a heavy fraction.

As mentioned above, the low-intensity thermal treatment can be performed as a standalone step, or it can be followed or preceded by a solvent deasphalting step. Details on each of these implementations are described hereinbelow.

Definitions

Throughout this description, numerous terms and expressions are used in accordance with their ordinary meanings. Below are definitions of some terms and expressions that are used in the description that follows:

"Bitumen" as used herein refers to hydrocarbon material extracted from bituminous formations, such as oil sands formations, the density of which is typically around 1000 kg/m$^3$, and the viscosity of which is typically between about 1 million cP to about 100 million cP measured at 20° C. Bitumen can be recovered from bitumen-containing ore by mining and extraction operations or from a bitumen-containing reservoir using in situ recovery processes. Examples of bitumen include bitumen extracted from the Athabasca and Cold Lake regions, in Alberta, Canada.

"Bitumen feedstock" refers to the bitumen material that is subjected to the partial upgrading. In some implementations, the bitumen feedstock includes both heavy and light hydrocarbon fractions and has very low or substantially zero water content and mineral solids content (e.g., below 2.5% water, or below 0.5% water and below 1.0% solids). The bitumen feedstock can include various non-hydrocarbon compounds (e.g., sulfur, metals, etc.) that are often found in bitumen and may be associated with certain hydrocarbon components (e.g., asphaltenes). The bitumen feedstock can be obtained from a diluent recovery unit that has received a diluted bitumen stream from an in situ recovery facility or a secondary extraction operation. In some implementations, the bitumen feedstock is a diluent-depleted bitumen stream that has not been subjected to certain conventional separation steps, such as fractionation or distillation, prior to the partial upgrading, and therefore still has many if not substantially all of the heavy and light hydrocarbon components of the native bitumen. In other implementations, the bitumen feedstock can be a residuum stream from a distillation tower (e.g., vacuum distillation tower) that has been operated to remove light hydrocarbon components (e.g., gas oils and other hydrocarbons that boil below about 525° C.). In other implementations, the bitumen feedstock can be a solvent-depleted bitumen produced by a solvent recovery unit (SRU) that recovers paraffinic solvent from a solvent diluted bitumen overflow stream that is part of a paraffinic froth treatment operation. By way of example, the bitumen feedstock can be 10 wt %-35 wt % saturates, 20 wt %-45 wt % aromatics, 20 wt %-40 wt % resins, and 10 wt % to 20 wt % asphaltenes (measured using Modified ASTM 2007, SARA), where approximately 30 wt %-60 wt % of the hydrocarbons are heavy with a boiling point over 525° C. Other properties of the bitumen feedstock include a hydrogen to carbon (H:C) molar ratio of about 1.2 to about 1.7 (e.g., around 1.5) and a density of between about 960 kg/m$^3$ and about 1200 kg/m$^3$. The bitumen feedstock can have an initial viscosity of between about 1 million cP and about 100 million cP at ambient temperature. In some examples, the bitumen feedstock has a viscosity between 50 thousand and 50 million cP, or between 80 thousand and 12 million cP at ambient temperature. It should also be noted that the bitumen feedstock can in some cases be a blend of different hydrocarbon streams, e.g., one or more heavy hydrocarbon streams can be blended with one or more light hydrocarbon streams to form a blended bitumen feedstock that has both heavy and light components (e.g., having properties as mentioned just above) to enable the liquid-phase hydrogen transfer during thermal treatment.

"Deasphalting" as used herein refers to a partial or a complete separation of the asphaltene fraction of a bitumen feedstock using a solvent, such as a paraffinic solvent. Asphaltene-reduced products obtained following a deasphalting step refer to product streams characterized by an asphaltene content that is partially or fully rejected.

"Fraction" as used herein refers to a collection of hydrocarbons that can be recovered and/or processed together. The fraction can contain, but is not limited to, hydrocarbons that are similar in composition, physical characteristics (e.g., viscosity), boiling point, location, geologic origin, or in recoverability or processability.

"Heavy fraction" as used herein refers to a hydrocarbon fraction having a boiling point above about 525° C. Typically, the heavy fraction will include asphaltenes along with smaller amounts of resins, aromatics and other hydrocarbon compounds. The heavy fraction can include hydrocarbon components that are commonly referred to as vacuum residue. When the bitumen feedstock is a blend of different streams, the heavy fraction can include residuum from a distillation tower (e.g., vacuum residue, which is the bottom cut from a vacuum distillation tower).

"Hydrogen transfer" as used herein refers to a preferential transfer of hydrogen from one fraction of hydrocarbons, for instance a heavy fraction comprising asphaltenes, to another fraction of hydrocarbons, for instance a light fraction that includes thermal cracking products formed under certain conditions of temperature, reaction time and pressure. During the thermal treatment as described herein, the operating conditions and bitumen feedstock composition are such that this hydrogen transfer occurs in the liquid hydrocarbon phase and results in hydrogen-depleted heavy hydrocarbons, and does not require an external gaseous hydrogen source. It should be noted that the liquid-phase "hydrogen transfer" described herein in the context of the partial upgrading techniques, should not be limited to a specific chemical reaction mechanism, but should be viewed as the general phenomenon forming a hydrogen-depleted heavy hydrocarbon phase and a hydrogen-enriched light hydrocarbon phase while maintaining the hydrocarbon components of the bitumen in substantially liquid phase during thermal treatment.

"Hydrogen transfer agent" as described herein refers to agents that can be added to be present during the thermal treatment to inhibit coke formation and encourage hydrogen transfer, for instance from the heavy fractions to the light fractions. Hydrogen transfer agents can be used to reduce the formation of olefins and to add volume to the processed bitumen feedstock. Hydrogen transfer agents can have the effect of increasing the time and temperature conditions at which incipient coking begins, thus enabling longer residence times or higher temperatures while still inhibiting coke formation. Such agents can be, for instance, methane, propane, butane and anthracene. Among possible hydrogen transfer agents are a class of compounds referred to as hydrogen donors. These hydrogen donors are able to donate hydrogen atoms to other compounds. Examples of hydrogen donors include, for instance, compounds such as tetralin, decalin, light crude oil, synthetic crude oil and fractions thereof, shale oil and tight oil. For clarity, it should be noted that hydrogen transfer agents, including hydrogen donors, are considered distinct from what is referred to herein as an external source of hydrogen, such as diatomic hydrogen ($H_2$) containing gas.

"Light fraction" as used herein refers to a hydrocarbon fraction having a boiling point of less than 525° C. For instance, the light fraction can include hydrocarbon components that are commonly referred to as vacuum gas oil, heavy gas oil and/or light gas oil in terms of boiling points.

"Lighter fraction" as used herein refers to a hydrocarbon fraction having a boiling point of less than about 350° C. For instance, the lighter fraction can include hydrocarbon components that are commonly referred to as distillate and/or a naphtha residue. "Lighter" is to be interpreted as being lighter than the light fraction based on one or more of the properties of the fractions mentioned above.

"Pipelinable bitumen" as used herein refers to a bitumen stream that meets a predetermined pipeline specification. For instance, a non-limiting example of a pipeline specification can require a viscosity of 350 cSt or less at the reference temperature of the pipeline and a density of 940 kg/m$^3$ or less. Other requirements can also be part of a pipeline specification, such as the olefin content of the bitumen, for instance an olefin content of less than 1 wt % (1-decene equivalent basis).

"Retaining" as used in the expression "retaining at least a portion of a lighter fraction in the thermally treated bitumen stream" as used herein refers to avoiding at least one of the degradation and the vaporization of the lighter fraction therefrom. In other words, the thermal treatment is operated to minimize the vaporization of the lighter fraction and to avoid the formation of a separate gas-phase hydrocarbon stream originating from the thermally treated bitumen stream.

"Severity" as used herein refers to the severity of the conditions of temperature and residence time at which the bitumen feedstock is treated. The severity can be expressed in terms of an equivalent reaction time (ERT) in seconds of residence time when a reactor is operating at 427° C. (800° F.). The ERT corresponds to the residence time that would achieve the same conversion of heavy material at a given temperature as if the reaction was conducted at 427° C. (800° F.).

"Upgrading" as used herein refers to a process where the bitumen is processed to improve its characteristics, for instance, by decreasing its viscosity and/or density or increasing its hydrogen-to-carbon ratio.

"Visbreaking" as used herein refers to a thermal treatment that can be used in the context of upgrading and which results in viscosity reduction of the bitumen feedstock. A "visbreaker" is a processing unit used to implement visbreaking. The low-intensity thermal treatment of the bitumen feedstock can be referred to as a type of visbreaking operation, as the thermal cracking results in a thermally treated bitumen stream that has a lower viscosity compared to the bitumen feedstock.

Bitumen Feedstock and Viscosity Characteristics

As mentioned above, techniques are described here to facilitate the reduction in viscosity of bitumen feedstocks. FIG. 1 illustrates the relationship between the volume of aggregates included in a bitumen stream and its viscosity, which increases in an exponential fashion. Thus, techniques for treating a bitumen feedstock such that the volume of aggregates included therein is reduced will have an impact on the pipelinability of the bitumen stream. The thermal treatment as described herein can enable viscosity reduction, in part due to a reduction or conversion in the volume fraction of aggregated material within the bitumen feedstock.

The bitumen feedstock can include bitumen that was extracted from oil sands ore using a surface mining process, or using an in situ recovery process (e.g., a thermal energy-based recovery method such as steam assisted gravity drainage (SAGD) or cyclic steam stimulation (CSS), a solvent-based recovery method such as in situ solvent or solvent-steam extraction, an in situ combustion recovery method, a cold production process, an electromagnetic energy assisted process, or a concurrent or sequential combination thereof). The bitumen included in the bitumen feedstock can also come from any other suitable source.

As mentioned above, the bitumen feedstock can be the diluent- or solvent-depleted bitumen stream from a diluent recovery unit. In addition, the bitumen feedstock can be substantially whole bitumen that has not undergone fractionation or distillation to remove light hydrocarbon components. The bitumen feedstock can include or be a bitumen stream that is produced by a diluent recovery unit (DRU or NRU) that recovers diluent (e.g., naphthenic diluent) from dilbit produced by a secondary extraction operation or an in situ recovery operation. The bitumen feedstock can include or be a bitumen stream that is produced by a solvent recovery unit (SRU) that recovers paraffinic solvent from a solvent diluted bitumen overflow stream that is part of a paraffinic froth treatment operation. The bitumen stream produced by the DRU or SRU can be supplied as the bitumen feedstock directly to the thermal treatment without any additional separation steps. Alternatively, the bitumen feedstock can be a blend of two or more hydrocarbon streams, which will be further described below.

Thermal Treatment

As mentioned briefly above, the thermal treatment is conducted in a thermal treatment unit at low-intensity conditions to maintain the hydrocarbon components substantially in liquid phase to facilitate hydrogen transfer from the heavy hydrocarbon fraction to the light hydrocarbon fraction and avoid coking. The resulting thermally treated bitumen stream can be withdrawn from the thermal treatment unit as a single liquid-phase stream including both heavy and light hydrocarbon components.

Conventional thermal treatment of bitumen usually involves heating the bitumen to a temperature above 475° C., at a pressure between 50 and 300 psi and for a residence time of about 10 to about 30 minutes in a conventional thermal cracking unit. In a delayed cocking unit, the residence time may be significantly higher in the coke drum depending on drum cycle time. These severe or high-intensity conditions lead to thermal cracking, coke formation, loss of hydrogen from the liquid hydrocarbon to a non-condensable gas phase, and production of by-products such as olefins. To obtain a treated bitumen meeting target quality specifications using such conventional severe conditions, hydrogen from an external source must be added via some form of hydroprocessing method to stabilize the cracked products and saturate the olefins.

When a thermal treatment is operated at less severe conditions, e.g., a mild thermal treatment at temperatures below 475° C., at pressures below 1000 psi but sufficient to maintain both light and heavy hydrocarbons in liquid phase, and for longer residence times, a preferential transfer of hydrogen from the heavy fraction to the lighter fraction occurs in the liquid hydrocarbon phase. This hydrogen transfer reduces or eliminates the amount of external hydrogen and/or diluent that would be otherwise required to be added to the bitumen to achieve target quality specifications. A hydrogen-depleted hydrocarbon fraction and a hydrogen-enriched hydrocarbon fraction are thus produced by the thermal treatment. The hydrogen-depleted hydrocarbon fraction can then be rejected, while the hydrogen-enriched hydrocarbon fraction may be ready for pipelining as a final bitumen product. Alternatively, after removal from the hydrogen-depleted hydrocarbon fraction, the hydrogen-enriched hydrocarbon fraction may be subjected to additional treatments, if desired, depending on the operating conditions that were used and the properties of the fraction, as will be explained in further detail below.

By operating the thermal treatment at mild conditions while keeping the hydrocarbon components in liquid phase, the hydrogen content of the heavy fraction can be advantageously leveraged via hydrogen transfer in the liquid phase to the light hydrocarbon components that are formed by thermal cracking, thus producing a thermally treated bitumen stream with reduced viscosity and increased hydrogen-to-carbon ratio, while enabling lower gas production and avoiding hydrogen losses to a non-condensable gas phase and coking compared to conventional high severity thermal cracking processes. The result is an efficient and effective thermal treatment that enables partial upgrading of the bitumen feedstock.

Figure 2:
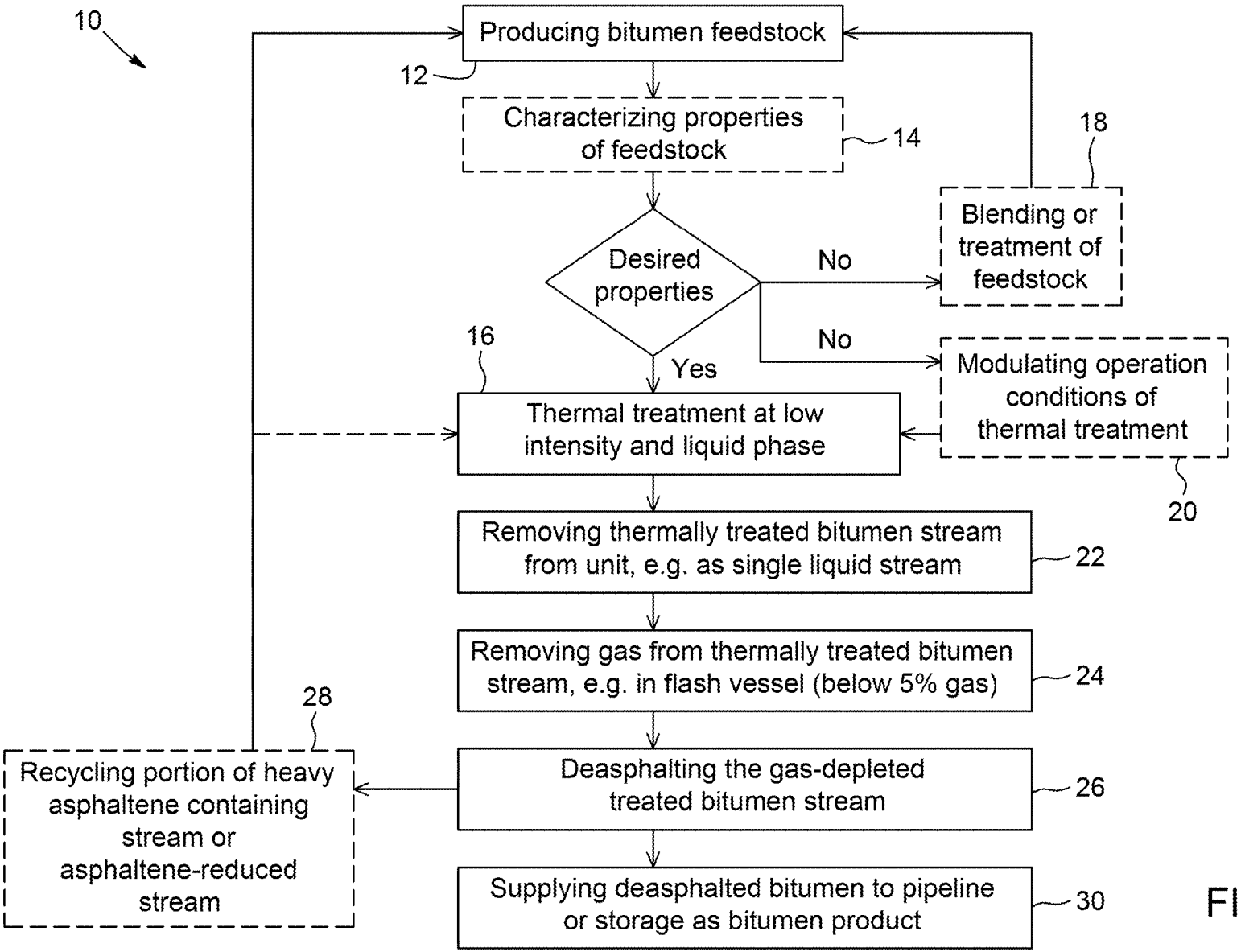
FIG. 2 is a flowchart of a process for treating a bitumen feedstock, in accordance with an implementation.

Referring to FIG. 2, one implementation of the partial upgrading process 10 includes the initial step of producing the bitumen feedstock 12, which can include blending multiple streams together or simply obtaining a diluent- or solvent-depleted bitumen stream from a DRU or SRU. Optionally, the bitumen feedstock 12 can be characterized in a characterizing step 14 to determine various properties including density, viscosity, composition, and so on. The properties that are determined can include, for example, the quantities of the heavy, light and lighter fractions that are present in the bitumen feedstock and can be used to adjust the operating conditions of the thermal treatment step 16. If the feedstock properties are desirable, the bitumen feedstock can be supplied directly to the thermal treatment unit. If the feedstock properties are not desirable, then the feedstock properties can be adjusted in a blending step 18 by adding other hydrocarbon streams or a modulating step 20 can be performed to adjust the operating conditions of the thermal treatment step. Adjusting the operating conditions can include modifying the temperature, residence time, or pressure, or adding external hydrogen or a hydrogen transfer agent. For instance, when a low level of heavy fraction is detected such that hydrogen transfer deficiency is expected, the thermal treatment can be operated to add a hydrogen-containing gas and/or a hydrogen transfer agent to the bitumen feedstock, as will be discussed in further detail below.

In the thermal treatment step 16, the bitumen feedstock is subjected to low-intensity thermal treatment to produce a thermally treated bitumen stream. The thermal treatment can include visbreaking of the bitumen. As mentioned above, the operating conditions of the thermal treatment are less severe than the conditions used for full upgrading of bitumen, for instance in terms of the temperatures and residence times used. For instance, in some implementations, the temperature of the thermal treatment is between about 200° C. and about 475° C., or between about 250° C. and about 450° C. In other implementations, the temperature of the thermal treatment is between about 350° C. and about 450° C., between about 350° C. and about 425° C., between about 360° C. and about 440° C., or between about 375° C. and about 425° C. In contrast, the temperatures for high-intensity thermal cracking of bitumen are typically in the range of 475° C. to 550° C., with a pressure of 50 to 300 psi, typically of 75 to 175 psi, for a short residence time of about 2 to 30 minutes. The operating conditions of the low-intensity thermal treatment performed in accordance with the techniques described herein (i.e., temperature, pressure and residence time) can delay or inhibit the onset of coking, reduce the extent of cracking of the heavy fraction, reduce the olefin formation, and promote hydrogen transfer from heavy to light fractions. In some implementations, limited cracking takes place, which can facilitate the reduction in olefins, hydrocarbon gas and solids that are generated. The thermal treatment as described herein can limit the rejection of hydrogen initially present within the bitumen hydrocarbon structures to a hydrogen gas that forms part of a non-condensable gas phase. In contrast, more severe thermal treatments as conventionally used result in the rejection of hydrogen as hydrogen-containing gas that forms part of the non-condensable gas stream that is separated from the liquid-phase hydrocarbon liquids, thereby resulting in hydrogen losses.

Additionally, the thermal treatment can be performed at high pressures to facilitate the retention of lighter hydrocarbons in the liquid phase, since the transfer of lower boiling products to the vapor phase is limited when the bitumen feedstock is subjected to higher pressures. In other words, higher pressures facilitate maintaining the bitumen feedstock as well as reaction products of the thermal cracking in liquid phase, which in turn promotes greater hydrogen transfer from heavy to light components. In some implementations, the gauge pressure to which the bitumen feedstock is subjected to during the thermal treatment is from about 50 psig to about 1500 psig, from about 50 psig to about 1000 psig, or from about 200 psig to 700 psig. Such pressure ranges can contribute to retaining at least a portion of the lighter fraction in the thermally treated bitumen stream. In some instances, substantially all of the lighter fraction and lighter reaction products resulting from the cracking are maintained in the liquid phase and can be collected as part of the thermally treated bitumen stream.

In some implementations, the bitumen feedstock is subjected to the thermal treatment for a time period of up to about 3000 minutes, up to about 300 minutes, from about 30 minutes to about 240 minutes, from about 60 minutes to about 240 minutes, or from about 5 minutes to about 60 minutes. It is appreciated that for a given temperature of the thermal treatment, the residence time can be prolonged to promote a higher level of hydrogen transfer while maintaining a controlled cracking of the heavy fraction. In contrast, conventional residence times for bitumen upgrading are in the range of about 2 minutes to about 30 minutes.

In some implementations, the severity of the thermal treatment is below the severity required for incipient coke formation. In other implementations, substantially no coke is formed during the thermal treatment. In particular, in some implementations, the severity of the thermal treatment is advantageously kept between 900 s and 1500 s ERT to minimize coke formation. The determination of the severity of the thermal treatment necessary to remain below and/or close to incipient coke formation can depend on the characteristics of the bitumen feedstock. For instance, a solvent-depleted bitumen feedstock obtained from a bitumen froth treatment operation, such as a paraffinic bitumen froth treatment operation, can be subjected to a thermal treatment at higher severity without substantially any coke formation since this bitumen feedstock is characterized by a lower proportion of asphaltenes, i.e., is an asphaltene-reduced bitumen feedstock. The severity of the thermal treatment can also depend on the process sequence, i.e., depending whether the thermal treatment is performed prior solvent deasphalting or after, as will be explained in further detail below. Since coke formation is a complex phenomenon, it should be noted that some limited coke or coke precursors may form, and periodic cleaning and maintenance of the thermal treatment vessels may be desirable. In addition, as will be discussed further below, coke formation can be reduced by adding certain hydrogen transfer agents that increase the severity threshold at which incipient coke formation occurs.

The operating conditions of the thermal treatment as described herein can facilitate the transfer of hydrogen from the heavy fraction of the bitumen feedstock to the light fraction of the bitumen feedstock, and can reduce or avoid the rejection of hydrogen as part of a non-condensable gas phase product. The hydrogen transfer can reduce or eliminate the amount of external diatomic hydrogen addition required to achieve target quality specifications of the partially upgraded product, such as the product's viscosity, density and olefin content. In some implementations, the addition of an external source of hydrogen is not required to achieve target quality specifications of the partially upgraded product. This is in contrast with typical thermal processes, in which significant cracking of the bitumen stream occurs, resulting in chemically bonded hydrogen in the bitumen feedstock being rejected to the gas phase. Consequently, in typical thermal processes, the liberation of hydrogen as a high hydrogen content non-condensable gas (e.g., a gas phase including diatomic hydrogen and methane)

typically results in a hydrogen-to-carbon ratio in the light fraction that is lower than or comparable to the hydrogen-to-carbon ratio of the feed. Lower hydrogen-to-carbon ratios is not desirable since one objective of partial upgrading is to increase the hydrogen-to-carbon ratio of the product. Thus, in some implementations, the operating conditions of the thermal treatment are chosen such that a balance is found between hydrogen transfer and thermal cracking of the hydrocarbons, while avoiding or minimizing external hydrogen addition, coking and/or olefin formation.

For instance, when the mild thermal treatment is operated at temperatures below about 400° C., it is expected that less than 5.0 wt % or even less than 1 wt % of 1-decene equivalent of olefin will be generated, generally taking away the need for the addition of an external source of hydrogen to the bitumen feedstock. In other implementations, for instance when the mild thermal treatment is operated at temperatures between about 400° C. and about 475° C., it is expected that a small amount of olefin will be produced, and thus a small amount of external hydrogen and/or a hydrogen transfer agent can be added to the liquid phase to reduce the olefin content and/or to delay the onset of coke formation.

The thermal treatment of the bitumen feedstock produces a thermally treated bitumen stream that includes a hydrogen-depleted fraction and a hydrogen-enriched fraction. Since cracking and condensation reactions modify the structure and properties of hydrocarbons initially present in the heavy fraction, light fraction, and lighter fraction present in the bitumen feedstock, it should be noted that the hydrogen-depleted fraction and the hydrogen-enriched fraction do not precisely correspond to the heavy and light fractions, respectively, although there is a general relationship between such fractions and many of the hydrocarbon molecules initially present in the heavy or light fraction will result in reaction products that remain in the hydrogen-depleted fraction and the hydrogen-enriched fraction, respectively.

Still referring to FIG. 2, after the thermal treatment step 16, the thermally treated bitumen stream undergoes a removal step 22 from the treatment unit. Depending on the type of thermal treatment unit used, the removal step can take various forms. In some implementations, the removal step 22 is performed such that substantially all of the contents of the thermal treatment unit is removed as a single stream that forms the thermally treated bitumen stream. Alternatively, two separate streams can be removed from the thermal treatment unit, e.g., a liquid phase underflow stream that includes a hydrogen-depleted fraction and the hydrogen-enriched fraction and constitutes the thermally treated bitumen stream, and an overhead gas phase stream that includes non-condensable gas-phase components.

Following removal from the thermal treatment unit, the thermally treated bitumen stream can be subjected to the step of removing gas 24. This step will be performed in particular if a single outlet stream is removed from the thermal treatment unit and thus any gases are removed as part of the thermally treated bitumen stream. The gas can include methane and small amounts of hydrogen, for example, and can make up less than 5 wt %, less than 4 wt %, less than 3 wt %, less than 2 wt % or less than 1 wt % of the thermally treated bitumen stream.

Optionally, the thermally treated bitumen stream or the gas-depleted treated bitumen stream can be subjected to a separation step, which can include separation in a flash column for example, to separate a thermally treated light fraction (including for instance distillate, gasoil and naphtha components), from a thermally treated heavy fraction. It is to be understood that when referring to this separation step, it can include a plurality of separation stages and units. For example, the plurality of separation steps could include a flash column followed by a fractionation column that receives the bottoms of the flash column, and then a vacuum distillation column that receives the bottoms of the fractionation column. Other arrangements of flash vessels, fractionation columns and distillation columns for separating the thermally treated stream into different output streams can also be implemented.

Thermal Treatment Followed by Deasphalting Implementations

After the gas removal step 24, the resulting gas-depleted thermally treated bitumen stream or the thermally treated heavy fraction can undergo a deasphalting step 26. The deasphalting step 26 can include the addition of a deasphalting solvent (e.g., an alkane-based solvent such as propane, butane, pentane, hexane and heptane, or a combination thereof; branched hydrocarbons, such as isopentane; and hydrocarbons that include cyclic structures, such as cyclopentane and cyclohexane) to encourage precipitation of asphaltenes present in the thermally treated bitumen stream while a portion of the light and lighter fractions can dissolve therein, and allow for a selective separation of the components according to their solubility properties in order to reject heavier components such as asphaltenes. Various solvent deasphalting (SDA) methods can be used for deasphalting the thermally treated bitumen stream and produce a deasphalted bitumen stream including a asphaltene-reduced fraction and an asphaltene-enriched stream.

Recycling of the Asphaltene-Enriched Stream or of the Asphaltene-Reduced Stream

Optionally, a recycling step 28 can be performed by recycling either a portion of the asphaltene-enriched stream or a portion of the asphaltene-reduced stream obtained from the thermally treated bitumen stream in the deasphalting step 26. When the gas-depleted thermally treated bitumen stream is subjected to the deasphalting step 26, the recycling step 28 is performed on the asphaltene-enriched stream, since the asphaltene-enriched stream produced by deasphalting is a heavy hydrocarbon stream that may contain residual transferable hydrogen, and the portion of the asphaltene-enriched stream that is recycled back into the bitumen feedstock can contribute to further deplete the heavy hydrocarbon stream from hydrogen and provide the residual transferable hydrogen to the light fraction of the bitumen feedstock. Recycling such asphaltene-enriched stream may depend on the extent of hydrogen transfer that occurs during the thermal treatment, e.g., low hydrogen transfer may result is higher residual hydrogen in the heavy fractions and thus the process may benefit from recycling asphaltene-enriched stream to further donate hydrogen. In some implementations, the range of the thermally treated heavy fraction recycled in the bitumen feedstock is between 10 vol % and about 50 vol %, or between about 10 wt % and about 30 vol %, which can also facilitate avoiding the need for the addition of an external source of hydrogen.

In an alternate configuration, when the thermally treated heavy fraction is subjected to the deasphalting step 26, the recycling step 28 is performed on the asphaltene-reduced stream. The recycle portion of the asphaltene-reduced stream, which can also be referred to as a deasphalted oil, produced during the solvent deasphalting step can be combined with the fresh bitumen feedstock to form part of the bitumen feedstock, which could also be referred to as total bitumen. Recycling part of the asphaltene-reduced stream directly to the thermal treatment unit can advantageously contribute to achieve a higher conversion of the heavy material of the bitumen feedstock or a heavy fraction of the asphaltene-reduced product. A single pass process that includes subjecting a bitumen feedstock to a thermal treatment step to produce a thermally treated bitumen stream followed by solvent deasphalting to reduce the asphaltene content of the thermally treated bitumen can produce a partially upgraded bitumen product having a vacuum residue fraction between approximately 25 vol. % and 35 vol. %. In such processes, the heavy material conversion has been estimated between approximately 30 vol. % to 45 vol. %. However, including a recycling step to recycle at least a portion of the asphaltene-reduced stream to form part of the bitumen feedstock and be fed directly back to the thermal treatment unit can contribute to achieving a higher conversion of the heavy material, for instance producing a partially upgraded bitumen product having a vacuum residue fraction between approximately 15 vol. % and 25 vol. %, which is estimated to correspond to a conversion of between approximately 45 vol. % to 65 vol. %. This is one example advantage of the recycling strategy incorporated into the partial upgrading process.

Still referring to FIG. 2, the thermally treated bitumen stream can then be supplied to pipelines or stored as a bitumen product 30.

Asphaltenes Processing

The characteristics of the asphaltene-enriched fraction recovered after the low-intensity thermal treatment step 16 are expected to be different from the characteristics of precipitated asphaltenes obtained from subjecting a bitumen feedstock comprising asphaltenes to conventional deasphalting. For instance, the H:C ratio of the former is expected to be lower than that of the latter. In some implementations, the process thus further includes processing the asphaltene-enriched fraction to produce an asphaltene-derived material. The asphaltene-enriched fraction can be processed to recover a portion of deasphalting solvent and lighter fractions therefrom. The asphaltene-enriched fraction can also be subjected to upgrading processes, such as thermal upgrading.

Thermal Treatment Preceded by Solvent Deasphalting Implementations

The implementations described hereinabove concern processes to partially upgrade a bitumen feedstock, and include a low-intensity thermal treatment, either as a standalone step or followed by solvent deasphalting of a given stream produced during the thermal treatment as a second step. Conversely and with reference to FIG. 3, other techniques for partially upgrading a bitumen feedstock in accordance with the present description concern processes 11 that include as a first step subjecting a bitumen feedstock to solvent deasphalting to produce an asphaltene-reduced bitumen stream and an asphaltene-enriched stream, and then as a second step, subjecting the asphaltene-reduced stream to a thermal treatment step.

Figure 3:
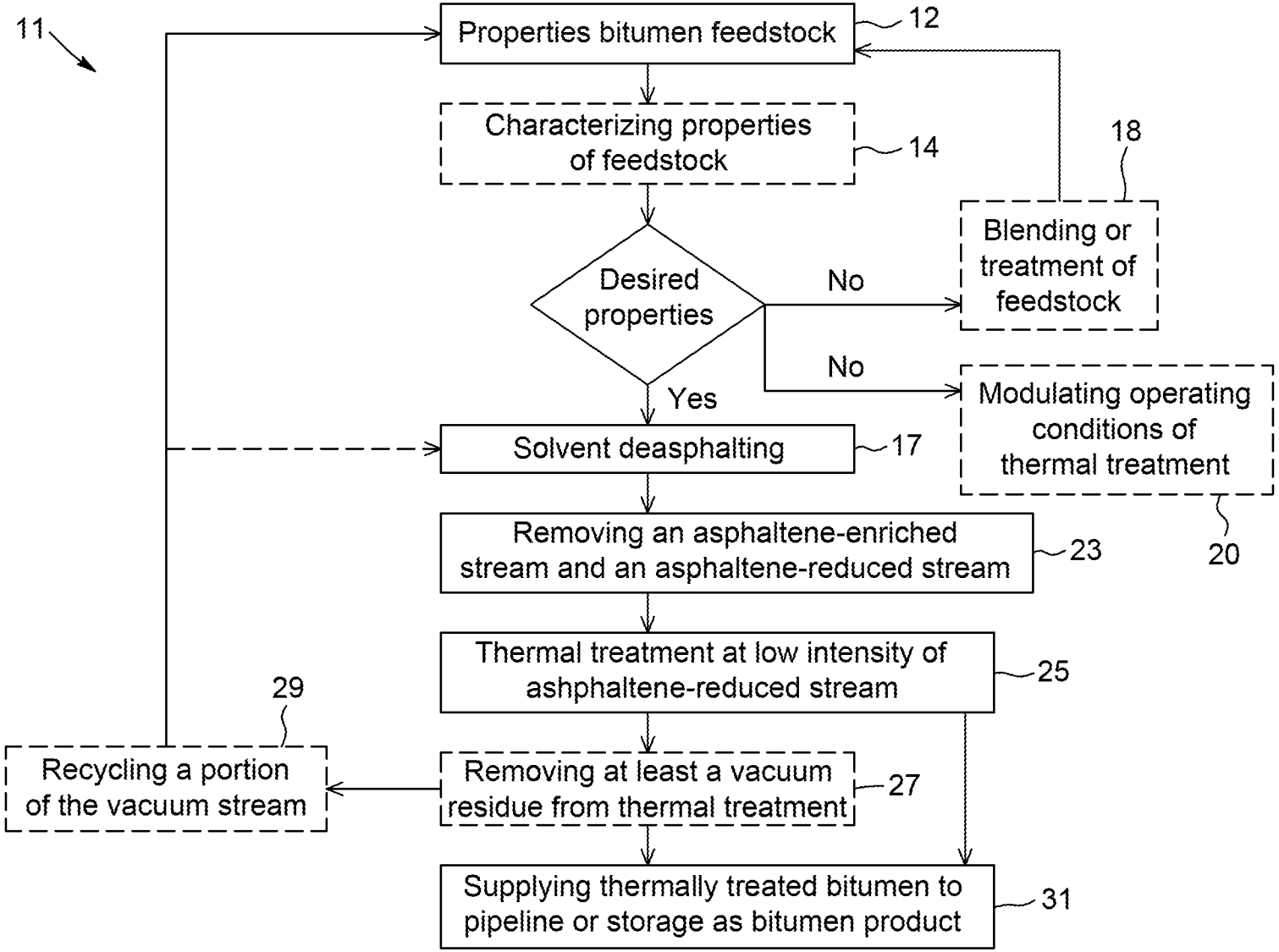
FIG. 3 is a flowchart of a process for treating a bitumen feedstock, in accordance with another implementation.

In FIG. 3, the initial step of producing the bitumen feedstock 12, optionally characterizing the bitumen feedstock 14, adjusting the properties of the feedstock properties if they are not desirable, either in a blending step 18 by adding other hydrocarbon streams or a modulating step 20 to adjust the operating conditions, this time of the solvent deasphalting step, are similar to the same steps described with reference to FIG. 2.

Then, the bitumen feedstock can be subjected directly to a solvent deasphalting step 17 to reject a portion of the asphaltenes therefrom and produce an asphaltene-reduced stream and an asphaltene-enriched stream. The operating conditions of the solvent deasphalting step can depend on the selected deasphalting solvent. For example, when pentane is used as the deasphalting solvent, the deasphalting step can be operated at temperatures ranging between about 90° C. and about 200° C., with a pressure of up to about 2000 psig, and with a solvent:bitumen ratio of 0.5 to 10.

Then, still in reference to FIG. 3, the asphaltene-reduced stream can be subjected to a low-intensity thermal treatment 25 to produce a single stream of thermally treated asphaltene-reduced stream. The process sequence, i.e., performing solvent deasphalting followed by a thermal treatment, can offer various advantages. For instance, because the asphaltene content in the stream subjected to thermal cracking is reduced compared to the asphaltene content of the original bitumen feedstock, less asphaltenes is available to contribute to coking, thus contributing to delay the onset of coking and allowing a higher severity thermal treatment to be performed. Accordingly, in some implementations, the operating conditions of the thermal treatment following solvent deasphalting can be between increased to between 1500 s to 5000 s ERT, compared to the range of 900 s to 1500 s when the thermal treatment is performed prior to solvent deasphalting. In some implementations, the operating temperatures and reaction times are similar for the process sequence [thermal treatment-solvent deasphalting] as for the process sequence [solvent deasphalting-thermal treatment].

The thermal treatment 25 of the asphaltene-reduced stream can include a separation step 27 to separate various components of the thermally treated asphaltene-reduced stream, according to their boiling point. For example, the thermally treated asphaltene-reduced stream can be separated to produce a light fraction and a heavy fraction. The light fraction can include for instance a naphtha stream, a distillate stream and a gasoil stream. The heavy fraction can be a vacuum residue stream.

Recycling of Thermally Treated Heavy Fraction

In some implementations, the heavy fraction produced during the separation step 27 following the thermal treatment 25 is recycled 29 to form part of the bitumen feedstock and be subjected to the process sequence [solvent deasphalting-thermal treatment] once again in a recycle mode. Using this recycle mode, it is expected that the amount of asphaltenes will generally increase in the recycle stream proportionally to the number of passes through the system since conversion with each pass will decrease.

Addition of Hydrogen Transfer Agents

Whether thermal cracking is performed as a standalone step, preceded or followed by solvent deasphalting, hydrogen transfer agents can be added during the thermal cracking step to increasing the time and temperature conditions at which incipient coking begins, thus enabling longer residence times or higher temperatures for the thermal treatment while still operating at conditions about or below incipient coke formation. In some implementations, an hydrogen transfer agent such as hydrogen, methane, butane, light hydrocarbons off gas stream or synthetic crude oil (SCO) can be added in a proportion of approximately 3 wt % to 5 wt % to achieve an additional 3 vol. % to 5 vol. % residue conversion.

Dilution of the Thermally Treated Bitumen Stream

Optionally, a dilution step can be performed to produce a diluted bitumen stream. With reference to FIG. 2, the stream subjected to the dilution can be the thermally treated bitumen stream or the asphaltene-reduced stream, depending on whether or not deasphalting has taken place, or, with reference to FIG. 3, the stream subjected to dilution can be the thermally treated asphaltene-reduced stream. The stream can be diluted to a predetermined pipeline specification. Examples of diluent include a hydrotreated naphtha or a naphthenic diluent. As mentioned earlier, the quantity of diluent added can be kept to a minimum by implementing the techniques described herein which provides a thermally treated light fraction within or close to pipeline requirements, for instance to reduce the associated costs.

Process Implementations

FIGS. 4 to 13 show schematic representations of various implementations of the processes described herein. In particular, FIGS. 4, 6 and 8 to 11 generally illustrate process implementations related to the sequence thermal treatment followed by solvent deasphalting, while FIGS. 5, 12 and 13 generally illustrate process implementations related to the sequence solvent deasphalting followed by thermal treatment. Each one of the processes depicted has shared elements. Although the process implementations as described herein and corresponding parts thereof consist of certain process configurations as explained and illustrated herein, not all of these components and process configurations are essential and thus should not be taken in their restrictive sense. It is to be understood, as also apparent to a person skilled in the art, that other suitable components and processing configurations can optionally be used for the process implementations for partially upgrading a bitumen stream, as will be briefly explained herein.

Figure 4:
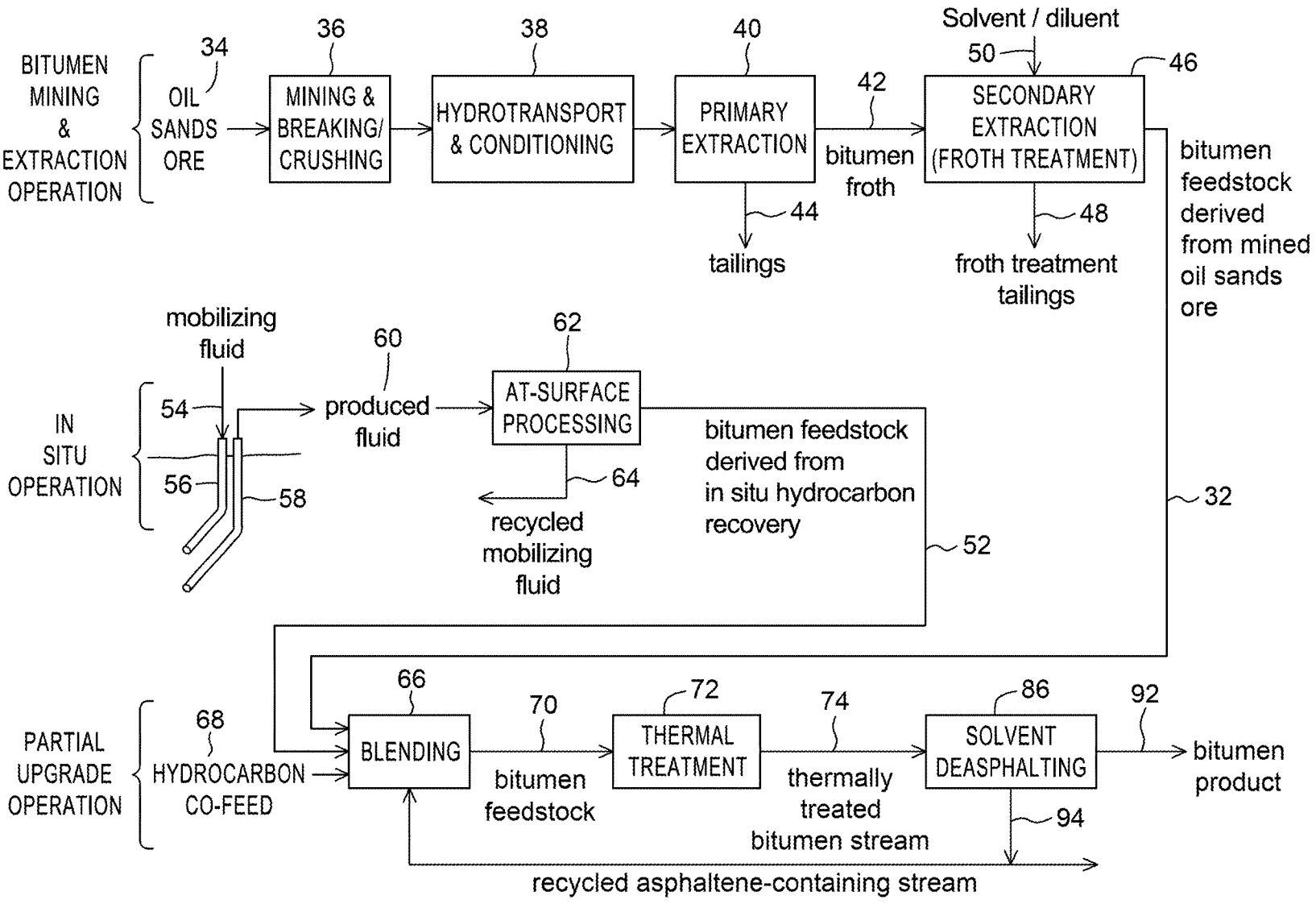
FIG. 4 is a schematic representation of a general flow diagram for treating a bitumen feedstock including a thermal treatment step followed by a solvent deasphalting step, wherein various bitumen recovery processes are shown.
Figure 5:
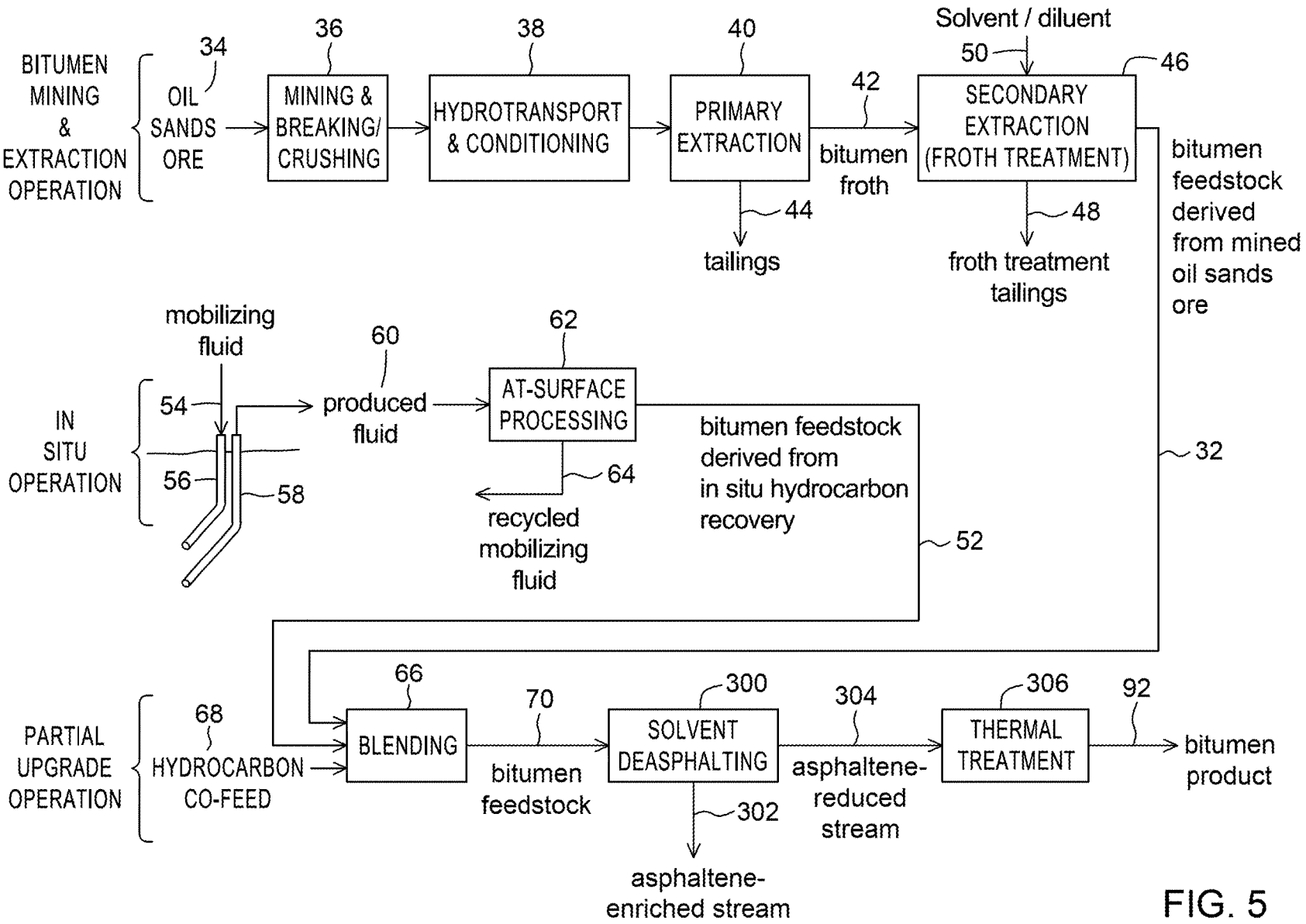
FIG. 5 is a schematic representation of a general flow diagram for treating a bitumen feedstock including a solvent deasphalting step followed by a thermal treatment step, wherein various bitumen recovery processes are shown.

Referring to FIGS. 4 and 5, the bitumen feedstock can include bitumen 32 extracted using surface mining operations. In such operations, the oil sands ore 34 is extracted through mining, followed by breaking down and crushing of the ore 36, which produces a looser material that can be mixed with warm or hot water to obtain a slurry preparation suitable for hydrotransport 38. At this stage, the slurry can also be subjected various forms of conditioning to improve its properties. The hydrotransport 38 provides a pipeline connection between mining operations 36 and primary extraction operations 40. The primary extraction 40 is performed to separate the hydrotransported slurry into a bitumen froth 42 and tailings 44. The bitumen froth 42 is then subjected to secondary extraction 46, or froth treatment, to separate the bitumen 32 from froth treatment tailings 48 using a solvent or diluent 50, thereby producing a bitumen feedstock suitable for the partial upgrading techniques described herein.

Still referring to FIGS. 4 and 5, the bitumen feedstock can also include bitumen 52 extracted using in situ recovery operations. In situ recovery operations comprises injecting a pre-heated mobilizing fluid 54 in an injection well 56 overlying a production well 58. A produced fluid 60 is extracted from the production well 58 and subjected to at-surface processing 62 to separate a stream of recycled mobilizing fluid 64 from a bitumen feedstock suitable for the partial upgrading techniques described herein. In some implementations, the bitumen feedstock subjected to partial upgrading can include bitumen extracted from various sources, combined in a blending step 66 prior to be subjected to the thermal treatment. A hydrocarbon co-feed 68 can also be added to the blending step 66.

Process Implementations Including a Thermal Treatment Followed by Deasphalting

Referring now to FIGS. 4, 6, and 8 to 10, a bitumen feedstock 70 is subjected to a thermal treatment 72. The thermal treatment 72 can be performed in a thermal treatment vessel configured to receive the bitumen feedstock 70, and produces a thermally treated bitumen stream 74. The thermal treatment 72 is configured such that at least a portion of the lighter fraction is retained in the liquid phase to allow a preferential transfer of hydrogen from the heavy fraction to the light fraction of the bitumen feedstock 70 directly in the liquid phase thereof, and the amount of non-condensable hydrocarbon gases generated is minimized. In some implementations, the thermal treatment vessel can include a visbreaker, for instance a coil visbreaking unit, a hydrovisbreaker unit or a soaker visbreaking unit. The thermal treatment vessel can also include one or more thermal chambers (e.g., an autoclave or a multi-compartment autoclave).

Figure 7:
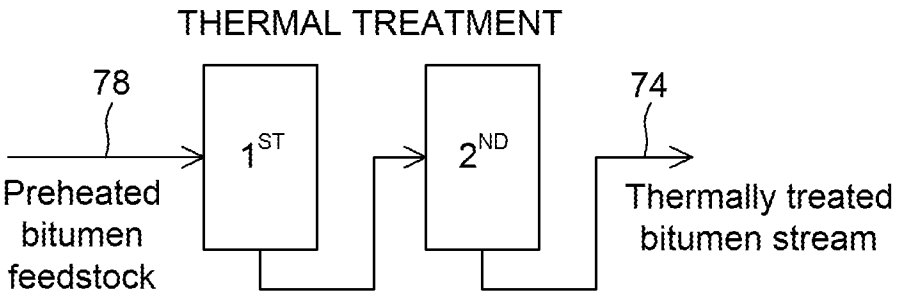
FIG. 7 is a schematic representation of a general flow diagram of another optional example process for treating a bitumen feedstock, including a plurality of thermal treatment vessels arranged in series.

Referring to FIG. 7, in some implementations, the thermal treatment 72 can be performed using a plurality of thermal treatment vessels, for instance arranged in series, i.e., in fluid communication. In other implementations, the thermal treatment can also be performed using a steam thermal treatment vessel, for example, when the temperature of the thermal treatment is desired to be lower than about 250° C.

Figure 6:
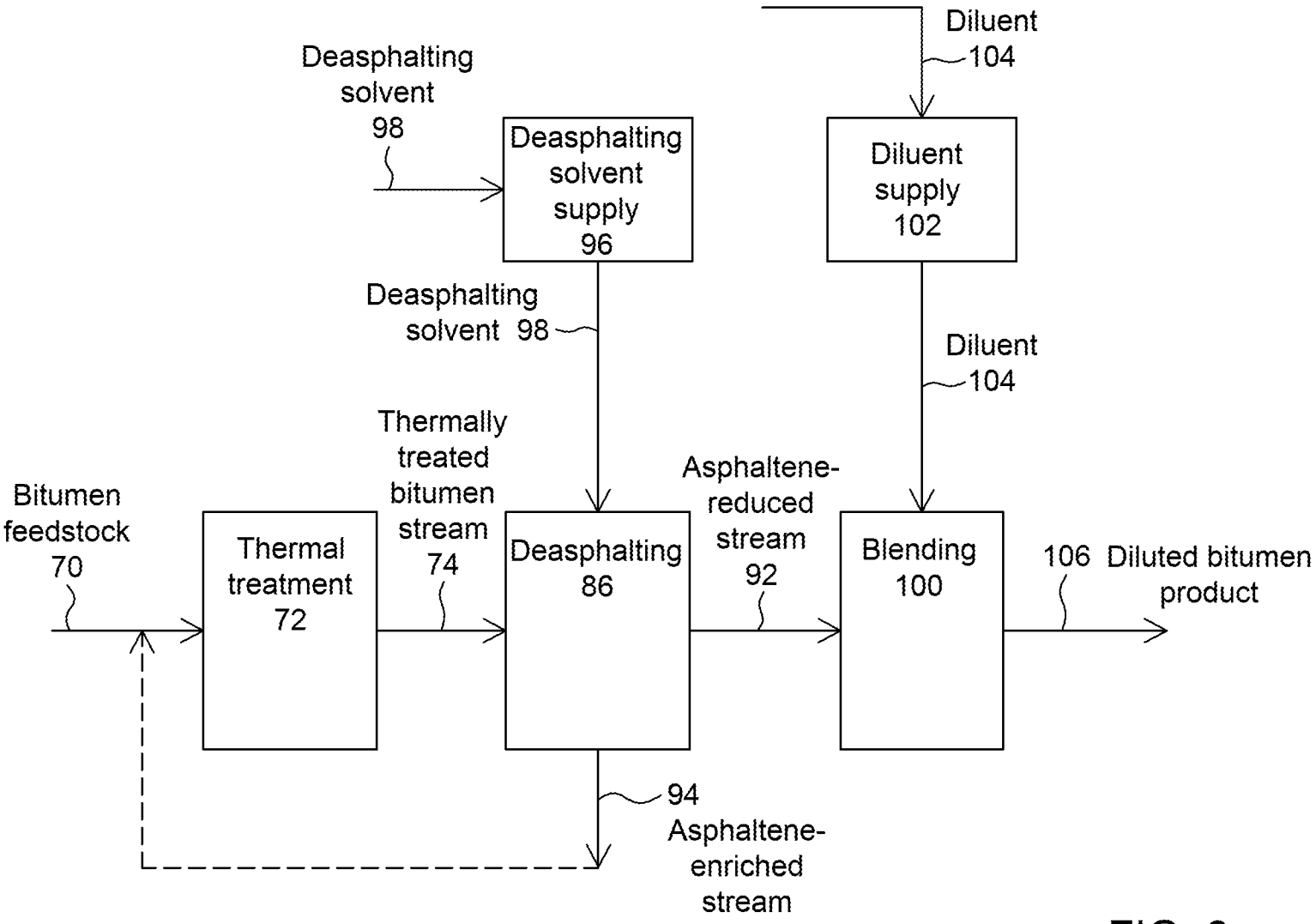
FIG. 6 is a schematic representation of a general flow diagram of an optional example process for treating a bitumen feedstock including a thermal treatment step followed by a solvent deasphalting step.
Figure 8:
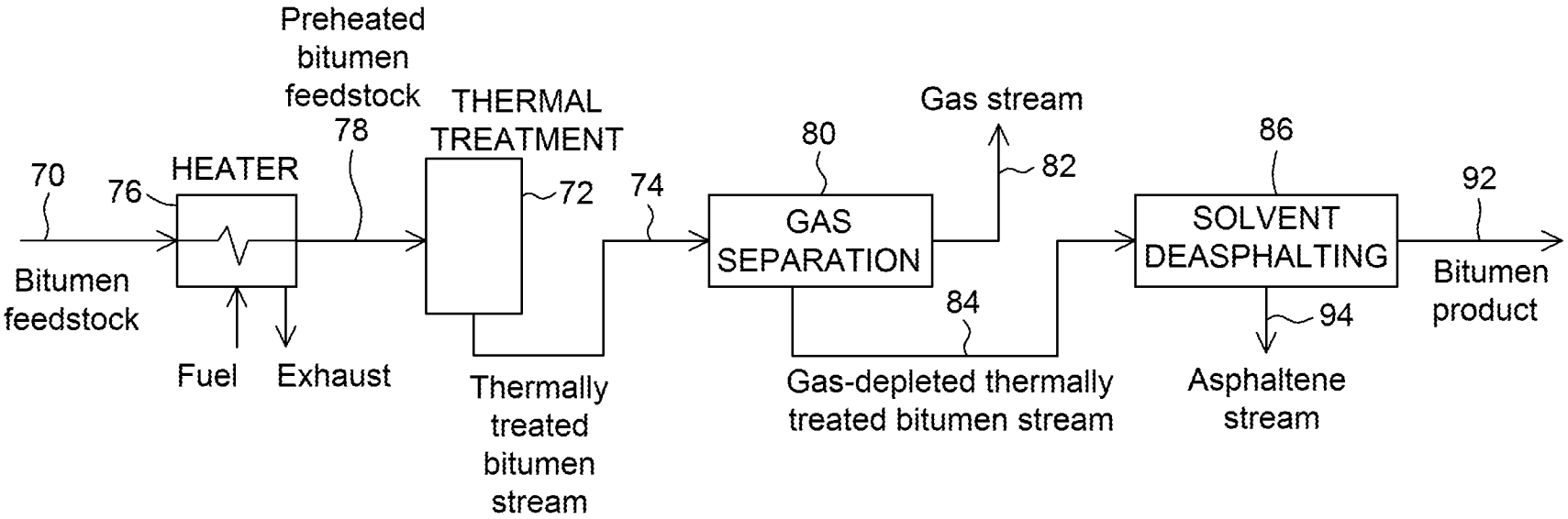
FIG. 8 is a schematic representation of a general flow diagram of another optional example process for treating a bitumen feedstock, including a heater to produce a preheated bitumen feedstock and a gas separation step.

Referring to FIG. 8, the thermal treatment 72 can also include heating the bitumen feedstock 70 using a natural gas fired heater 76 to preheat the bitumen feedstock 70 to a predetermined temperature to produce a preheated bitumen feedstock 78 prior to the bitumen feedstock 70 being subjected to the thermal treatment. The thermally treated bitumen stream 74 produced the thermal treatment vessel can be routed as a single liquid-phase stream including both the hydrogen-depleted fraction and the hydrogen-enriched fraction for further conditioning in part or in whole. As mentioned hereinabove, two separate streams of the thermally treated bitumen stream 74 can be extracted from the thermal treatment vessel, i.e. a liquid phase underflow stream and an overhead gas phase stream (not shown). Referring to FIG. 6, the thermally treated bitumen stream 74 can also be subjected to gas separation 80 to separate gas-phase components therefrom and produce a gas stream 82 and a gas-depleted thermally treated bitumen stream 84.

Figure 9:
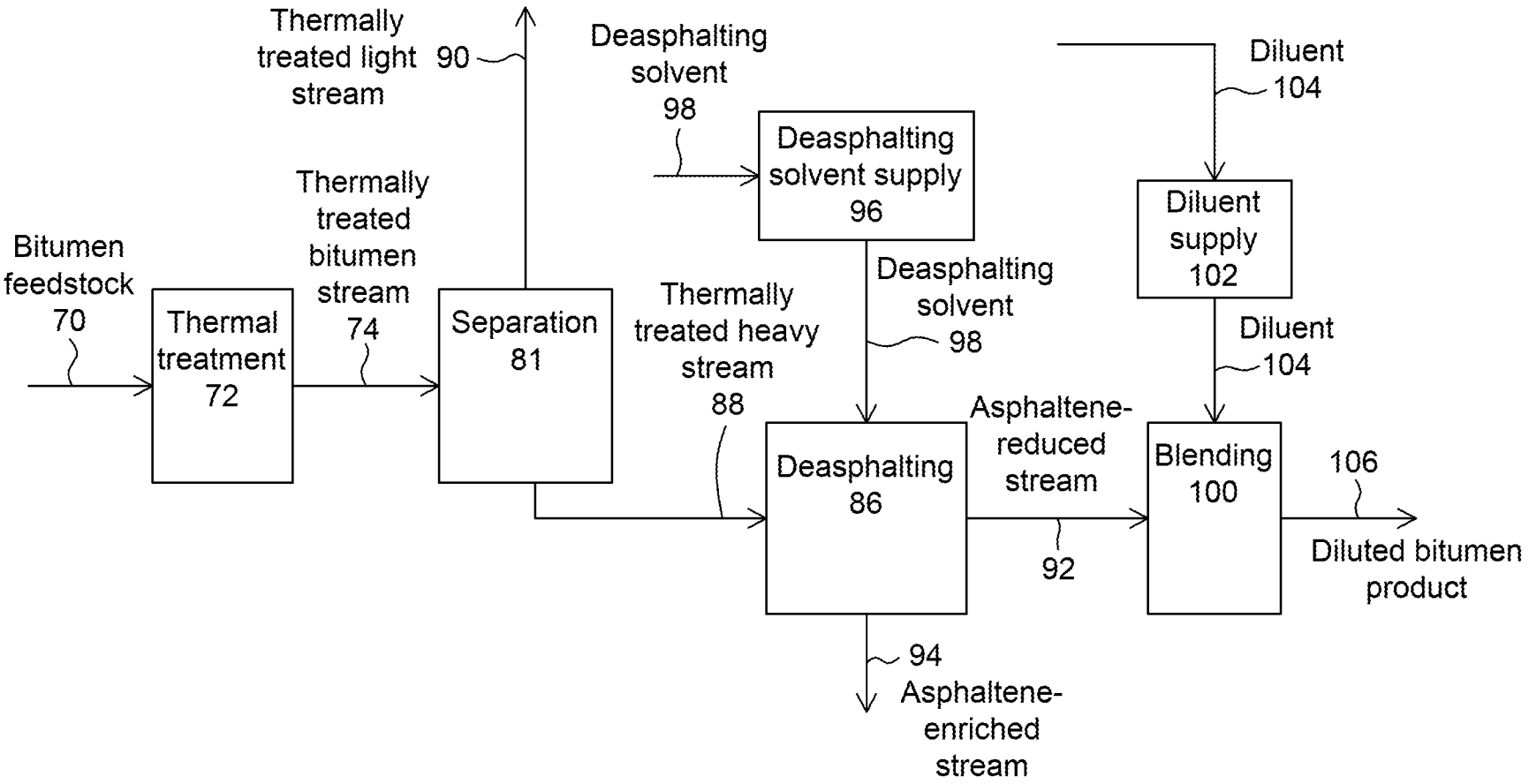
FIG. 9 is a schematic representation of a general flow diagram of another optional example process for treating a bitumen feedstock, including a separation step following the thermal treatment.

Referring to FIGS. 6 and 8 to 10, in some implementations, the thermally treated bitumen stream 74 or the gas-depleted thermally treated bitumen stream 84 is subjected to solvent deasphalting 86. Referring to FIG. 9, in other implementations, the thermally treated bitumen stream 74 is first subjected to a separation step 81 to produce a thermally treated heavy stream 88 and a thermally treated light stream 90 according to conventional methods. The separation step 81 can comprise separating the thermally treated bitumen stream into the thermally treated heavy stream 88 and the thermally treated light stream 90 through processes such as fractionation, stripping, flashing, distillation, selective adsorption or liquid-liquid extraction. The thermally treated heavy stream 88 can then be separated and subjected to further conditioning, for instance solvent deasphalting 86.

In both implementations described above, solvent deasphalting 86 enables the production of a deasphalted bitumen stream comprising an asphaltene-reduced stream 92 and an asphaltene-enriched stream 94. The solvent deasphalting 86 can be performed in a solvent deasphalting unit operable according to conventional methods. In order to perform solvent deasphalting, a deasphalting solvent supply 96 provides a deasphalting solvent 98 to the thermally treated bitumen stream 74 or the thermally treated heavy stream 88. The deasphalting solvent supply 96 can be a fresh deasphalting solvent supply, or can be a recycled feed of deasphalted solvent recovered from the solvent deasphalting unit or a combination of both a fresh supply and a recycled feed (see FIG. 8). In some implementations, the deasphalted bitumen stream and the deasphalting solvent are allowed to settle and decant to separate the asphaltene-reduced stream 92 from the asphaltene-enriched stream 94. The asphaltene-reduced stream 92 can be discharged at the top of the deasphalting unit, while the asphaltene-enriched stream 94 can settle at the bottom of the deasphalting unit and be recovered therefrom. Optionally, as described hereinabove, the asphaltene-enriched stream 94 extracted following solvent deasphalting 86 can be recycled back into the bitumen feedstock 70 to further deplete the asphaltenes from hydrogen.

Figure 10:
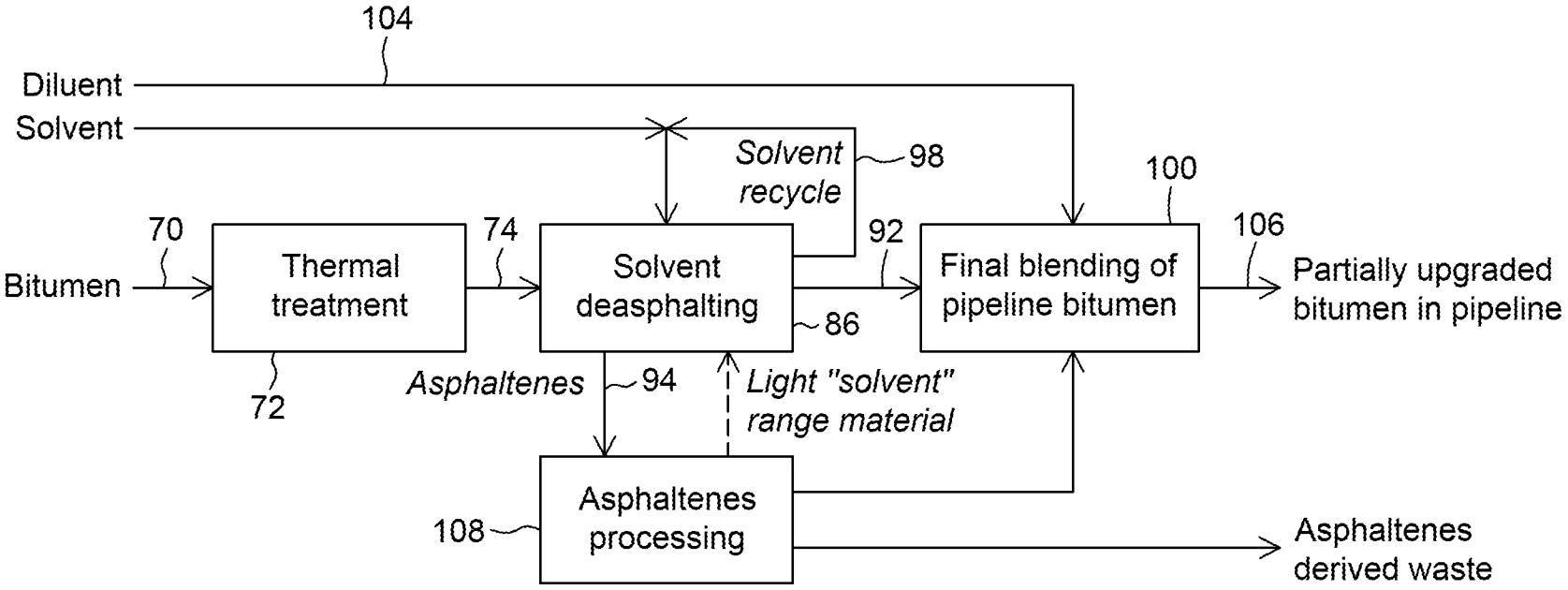
FIG. 10 is a schematic representation of a general flow diagram of another optional example process for treating a bitumen feedstock, including an asphaltenes processing step.

In the implementations shown in FIGS. 6, 9 and 10, the asphaltene-reduced stream 92 is subjected to a blending step 100, for instance in a blending unit in fluid communication with a diluent supply 102. The blending step 100 blends the asphaltene-reduced fraction 92 with a diluent 104 to produce a diluted bitumen product 106. The blending step 100 can be optional depending of the viscosity of the asphaltene-reduced stream 92 and the requirements dictated, for example, by the predetermined pipeline or other end use specification. In some implementations, the thermally treated light stream 90 from the separation step 81 can also be blended with the asphaltene-reduced stream 92 in the blending step 100 (not shown). In other implementations, a diluent can be supplied directly to the asphaltene-reduced stream 92 to produce the diluted bitumen product 106.

Referring to FIG. 10, in some implementations, the process can further include processing the asphaltenes 108, for instance in an asphaltenes processing unit configured to receive the asphaltene-enriched stream 94. The asphaltenes processing can be useful to further process the asphaltenes.

Figure 11:
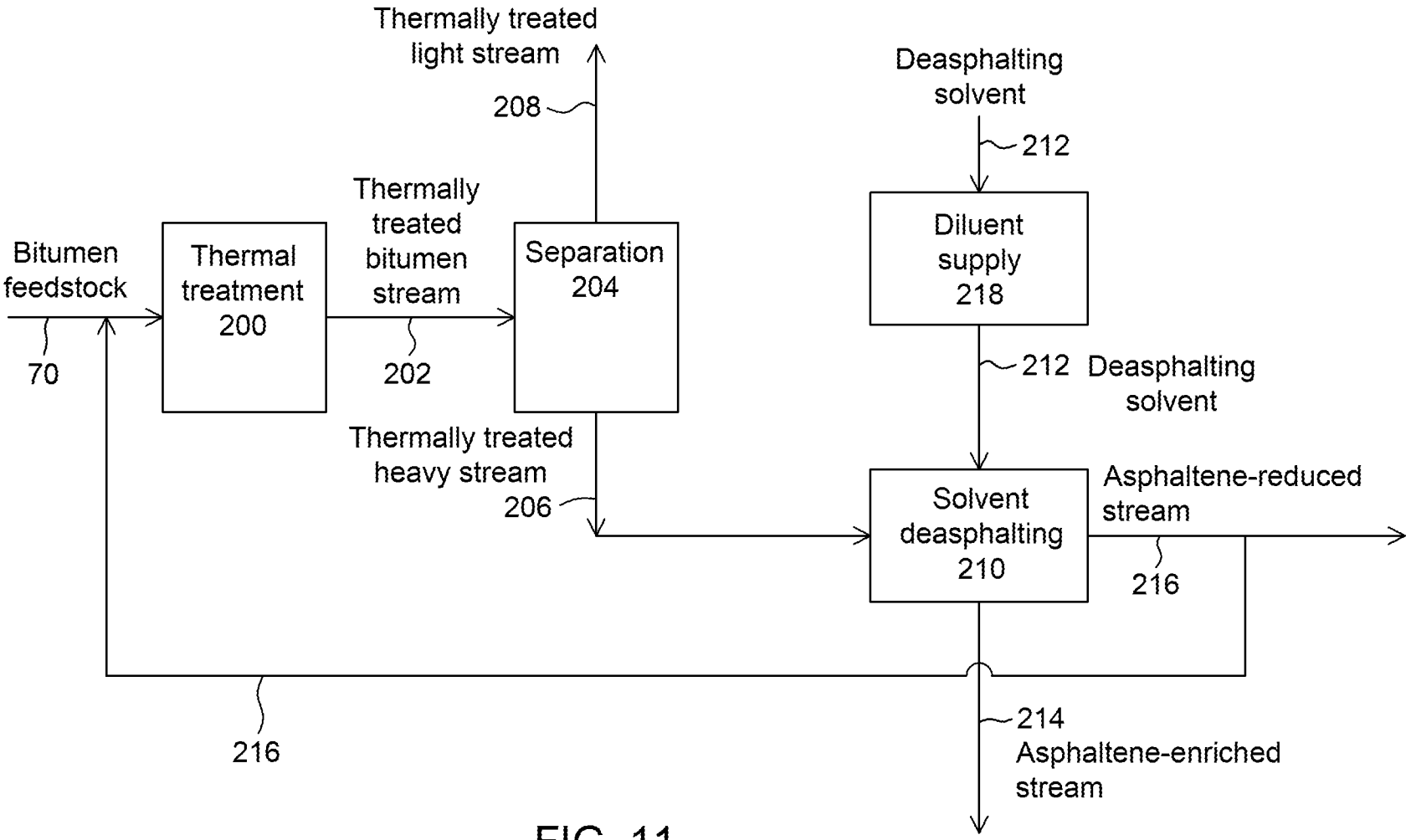
FIG. 11 is a schematic representation of a general flow diagram for treating a bitumen feedstock including a thermal treatment step followed by a solvent deasphalting step, wherein a portion of an asphaltene-reduced stream is recycled to form part of the bitumen feedstock.

Referring to FIG. 11, in some implementations, the bitumen feedstock 70 is first subjected to a thermal treatment 200 in a thermal treatment vessel as described above to produce a thermally treated bitumen stream 202, followed by a separation step 204 to produce a thermally treated light stream 208 and a thermally treated heavy stream 206. The separation step 204 can include one of fractionating, stripping, flashing, distillation, selective adsorption and liquid-liquid extraction of the thermally treated bitumen stream 202. The separation step 204 can be performed in a separate vessel or in a plurality of successive separation vessels. The thermally treated heavy stream 206 is then subjected to a solvent deasphalting step 210 in a solvent deasphalting unit. The solvent deasphalting unit is in fluid communication with a solvent supply 218 to provide a deasphalting solvent 212 for deasphalting the thermally treated heavy stream 206. The deasphalting solvent supply 218 can be a fresh deasphalting solvent supply, or can be a recycled feed of deasphalted solvent recovered from the solvent deasphalting unit or a combination of both a fresh supply and a recycled feed. The solvent deasphalting step 210 produces an asphaltene-enriched stream 214 and an asphaltene-reduced stream 216. At least a portion of the asphaltene-reduced stream 216 is recycled to form part of the bitumen feedstock 70 and be subjected once again to the thermal treatment 200 and to solvent deasphalting 210. In some implementations, the asphaltene-reduced stream 216 forming part of the bitumen feedstock 70 is fed directly back into the thermal treatment vessel, without being subjected to any further treatments such as distillation.

To determine the proportion of the asphaltene-reduced stream 216 to be recycled, the asphaltene-reduced stream 216 can be monitored, for instance to obtain information regarding properties of the asphaltene-reduced stream 216, such as its composition, viscosity and/or density. The proportion of the asphaltene-reduced stream 216 to be recycled can also be determined based on the characteristics of the resulting combined stream formed by the bitumen feedstock 70 and the asphaltene-reduced stream 216. In some implementations, the proportion of the asphaltene-reduced stream 216 forming part of the bitumen feedstock 70 is less than 30 vol. %. In yet other implementations, the proportion of the asphaltene-reduced stream 216 to be recycled can be determined in accordance with the desired properties of the bitumen product. For instance, for given properties of a bitumen feedstock, the recycle conditions can be adjusted in order to meet target properties of the bitumen product.

Process Implementations Including a Thermal Treatment Preceded by Deasphalting

Figure 12:
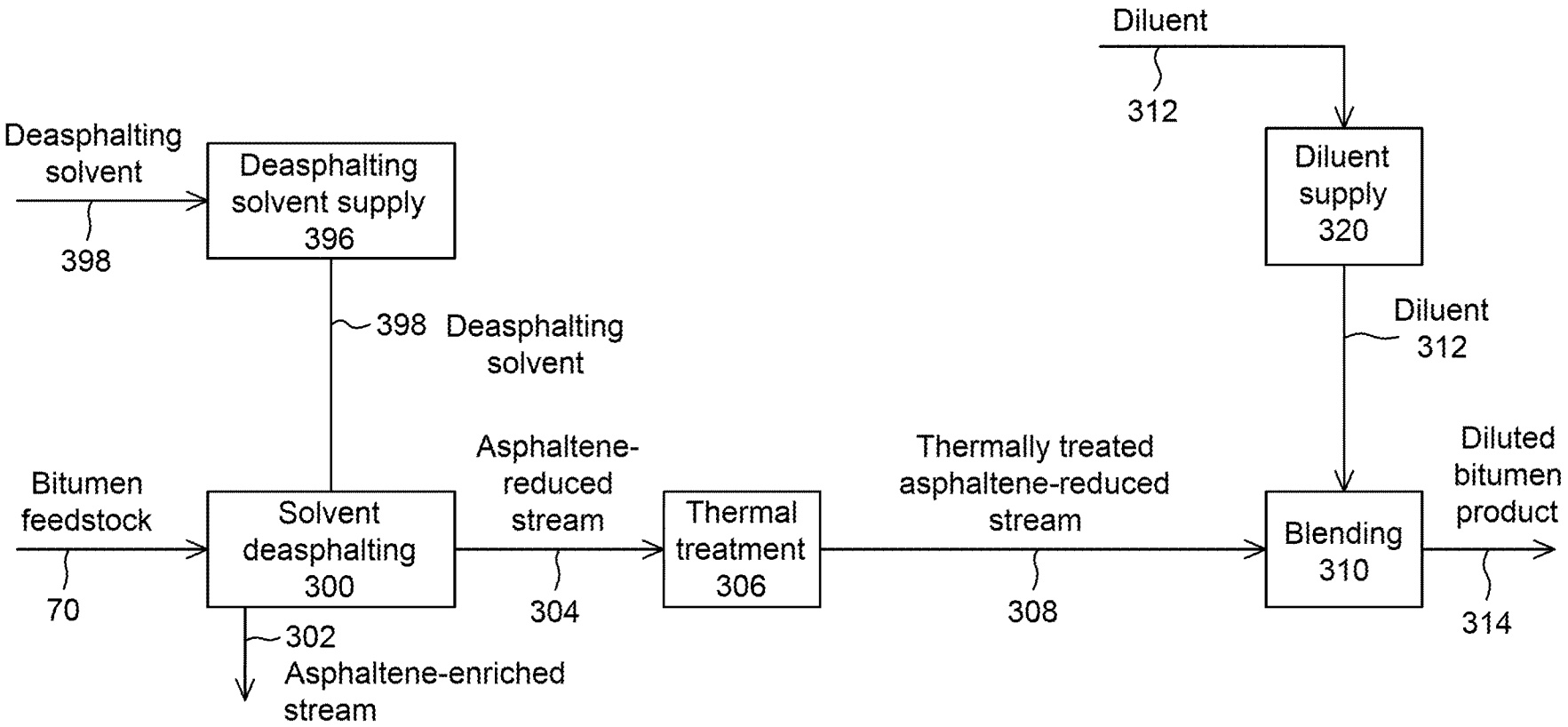
FIG. 12 is a schematic representation of a general flow diagram for treating a bitumen feedstock including a solvent deasphalting step followed by a thermal treatment step.
Figure 13:
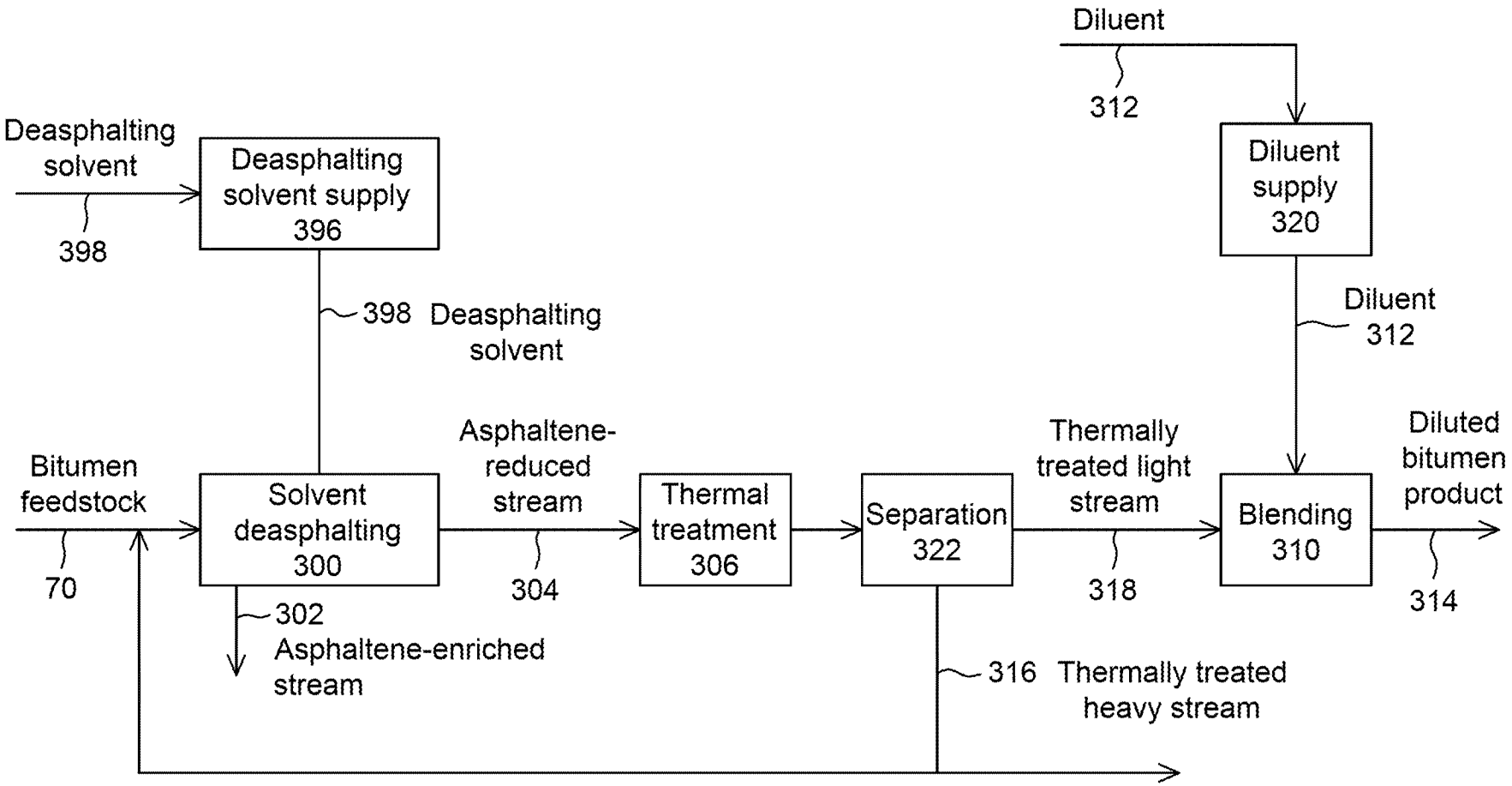
FIG. 13 is a schematic representation of a general flow diagram for treating a bitumen feedstock including a solvent deasphalting step followed by a thermal treatment step, wherein a thermally treated residue stream is recycled to form part of the bitumen feedstock.

Referring now to FIGS. 12 and 13, the bitumen feedstock 70 is subjected to a solvent deasphalting step 300 in a solvent deasphalting unit to produce an asphaltene-enriched stream 302 and an asphaltene-reduced stream 304. The solvent deasphalting unit 300 can be operated according to conventional methods. As mentioned above, a deasphalting solvent supply 396 provides a deasphalting solvent 398 to the bitumen feedstock 70. The deasphalting solvent supply 396 can be a fresh deasphalting solvent supply, or can be a recycled feed of deasphalted solvent recovered from the solvent deasphalting unit or a combination of both a fresh supply and a recycled feed.

The asphaltene-reduced stream 304 is then supplied to a thermal treatment unit to be subjected to a thermal treatment 306. The thermal treatment 306 is performed in a thermal treatment vessel configured to receive the asphaltene-reduced stream 304. In some implementations and as shown in FIG. 12, the thermal treatment 306 produces a thermally treated asphaltene-reduced stream 308. As mentioned above, the thermal treatment vessel can include a visbreaker, for instance a coil visbreaking unit, a hydrovisbreaker unit or a soaker visbreaking unit, and can also include one or more thermal chambers. The thermal treatment 306 can be performed using a plurality of thermal treatment vessels. The thermal treatment 306 can be performed using a steam thermal treatment vessel. In some implementations, the thermally treated asphaltene-reduced stream 308 obtained following thermal treatment 306 in the thermal treatment vessel can be routed as a single liquid-phase stream for further conditioning, such as blending 310, to form a diluted bitumen product 314.

In other implementations and as shown in FIG. 13, the thermal treatment 306 can include a separation step 322 to produce a thermally treated heavy stream 316 and a thermally treated light stream 318. The thermally treated light stream 318 can include different products, for instance naphtha, distillate, and/or gasoil. The thermally treated light stream 318 can then be subjected to further conditioning. The conditioning can include a blending step 310, for instance in a blending unit in fluid communication with a diluent supply 320. The blending step 310 is configured to blend the thermally treated light stream 318 with a diluent 312 to produce a diluted bitumen product 314.

Still with reference to FIG. 13, in some implementations, the thermally treated residue stream 316 can be recycled to form part of the bitumen feedstock 70 and be subjected once again to solvent deasphalting 300 and the thermal treatment 306 in a recycle mode. To determine the proportion of the thermally treated residue stream 316 to be recycled, the thermally treated residue stream 316 can be monitored, for instance to obtain information regarding properties of the thermally treated residue stream 316, such as its composition, viscosity and/or density. The proportion of the thermally treated residue stream 316 to be recycled can also be determined based on the characteristics of the resulting combined stream formed by the bitumen feedstock 70 and the thermally treated residue stream 316. In some implementations, the proportion of the thermally treated residue stream 316 forming part of the bitumen feedstock 70 is about 50 vol. %.

Experimental Results & Calculations

Various experiments and calculations were conducted to illustrate some aspects of the processes and systems described herein on a bitumen stream.

Theoretical Amount of Diluent Required to Meet a Pipeline Specification

Thermal Treatment

This first example was aimed at evaluating the effect of a mild thermal treatment on the viscosity of a bitumen feedstock and the associated diluent requirements necessary to reach a pipeline specification, compared to the corresponding requirements for raw bitumen. A diluent-viscosity relationship described in the document Miadonye, A., Latour, N., Puttagunta, V. R. *A correlation for viscosity and solvent mass fraction of bitumen-diluent streams. Petrol. Sci. Technol.* 2000, 18, 1-14, was used to perform the calculations.

Figure 14:
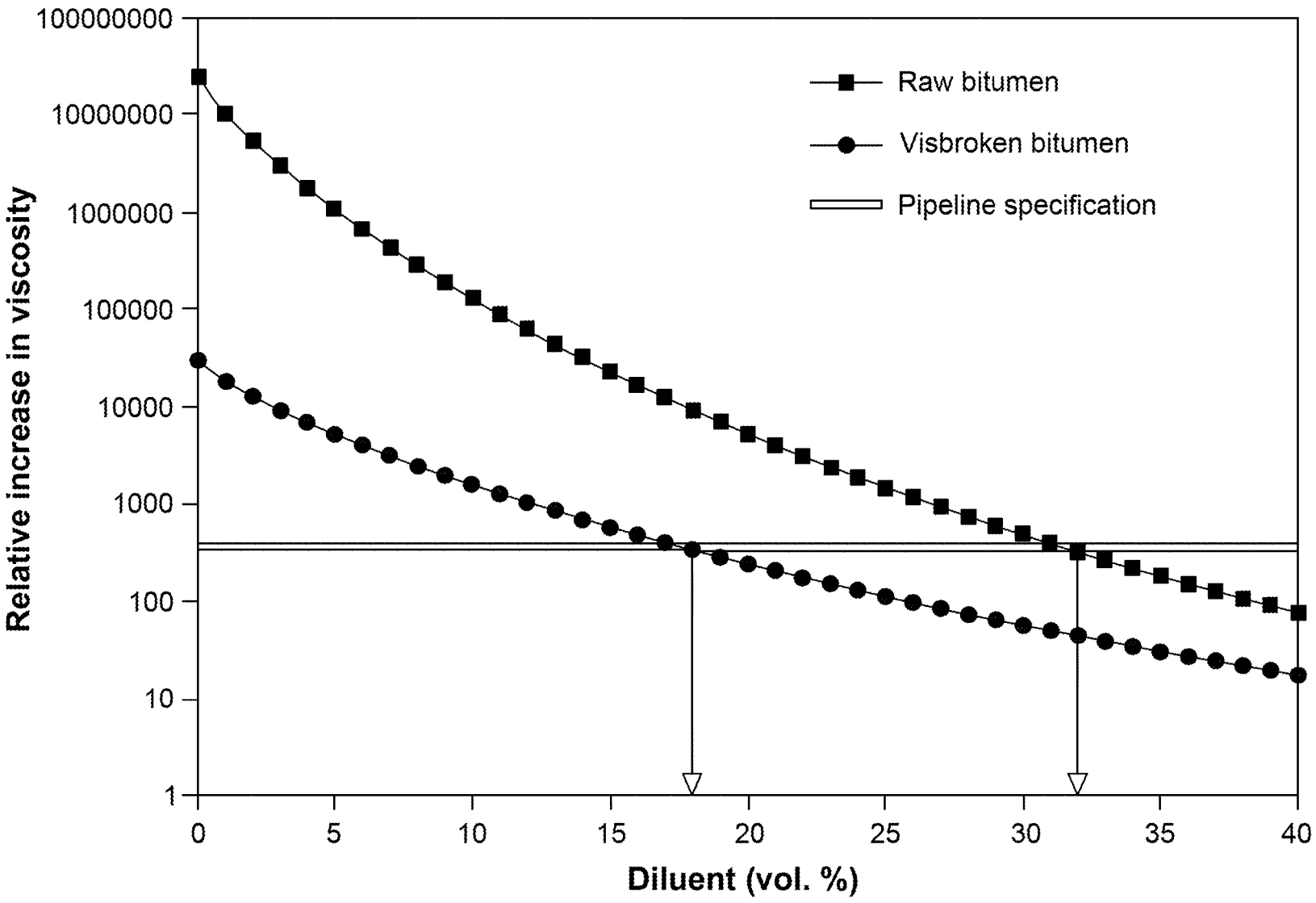
FIG. 14 is a graph depicting a theoretical requirement of the percentage by volume of diluent to be added to each one of a raw bitumen and a visbroken bitumen to meet a pipeline viscosity specification of 350 cSt.

According to this relationship, and referring to FIG. 14, a bitumen feedstock subjected to a thermal treatment at 300° C. for 2 hours would require an addition of about 18 vol % of diluent to reach a viscosity of approximately 350 cSt. On the other hand, the graph shows that for the raw bitumen feedstock, about 32 vol % of diluent would be required to meet the pipeline specification.

Therefore, the amount of diluent required to meet the pipeline viscosity specification could be decreased from 32 vol % to 18 vol % following such mild thermal treatment. Using these conditions, the olefin content of the thermally treated bitumen stream is expected to be less than 5.0 wt % or even less than 1 wt % 1-decene equivalent.

Thermal Treatment Followed by Solvent Deasphalting

This second example was aimed at evaluating the effect of a mild thermal treatment followed by solvent deasphalting on the viscosity of a bitumen feedstock and the associated diluent requirements necessary to reach the pipeline specification, compared to the corresponding requirements for raw bitumen. The same diluent-viscosity relationship as described in Example 1 was used to perform the calculations, combined with literature data for evaluating the viscosity reduction resulting from a deasphalting treatment performed with a pentane solvent at 100° C. (Le Page, J-F.; Chatila, S. G.; Davidson, M. *Resid and heavy oil processing*; Editions Technip: Paris, 1992).

Figure 15:
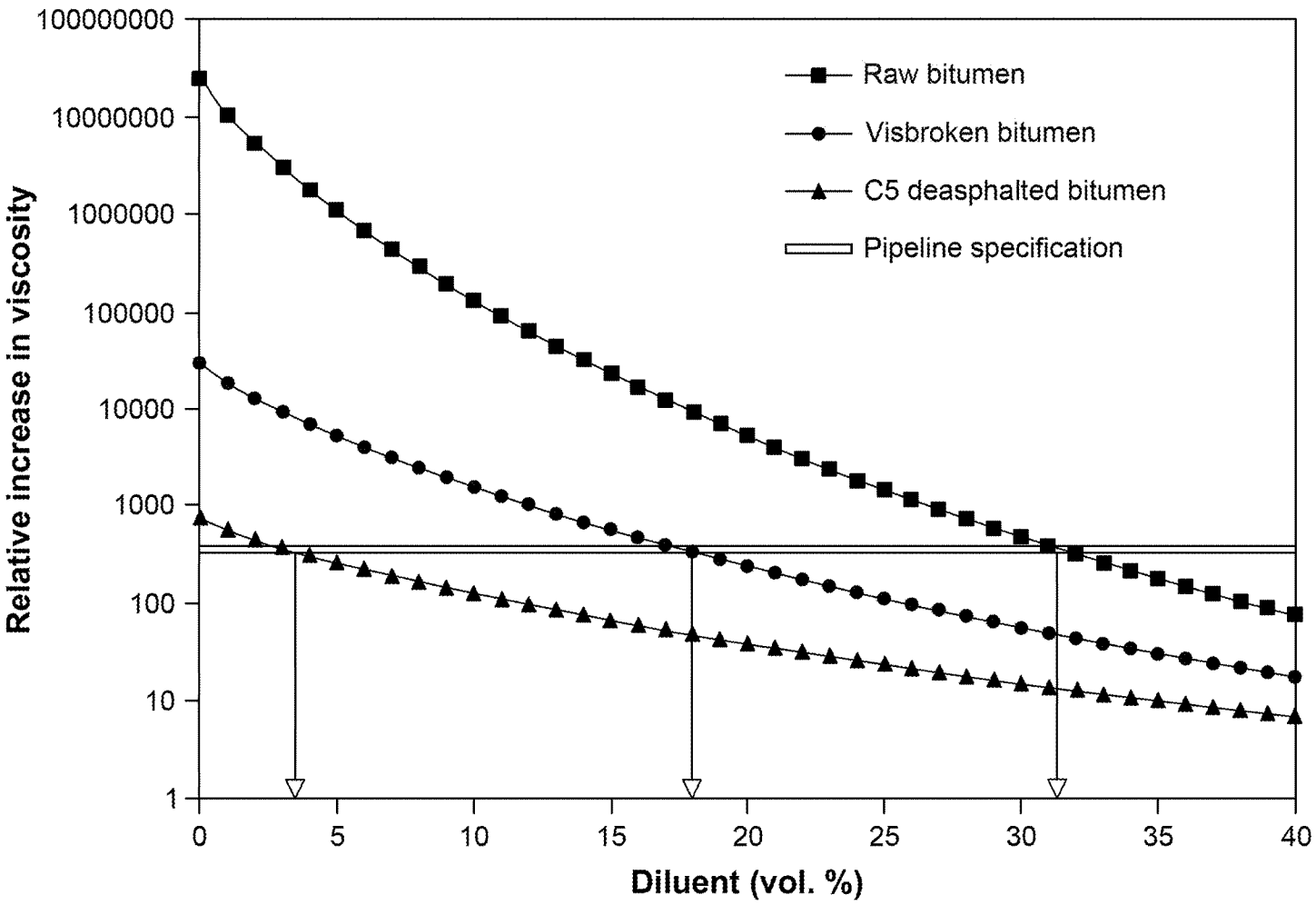
FIG. 15 is a graph depicting a theoretical requirement of the percentage by volume of diluent to be added to each one of a raw bitumen, a visbroken bitumen and a visbroken-solvent deasphalted bitumen to meet a pipeline specification of 350 cSt.

Referring to FIG. 15, according to the calculations performed and assuming that solvent deasphalting of a thermally treated bitumen stream has the same viscosity response as for a typical vacuum residue, it was found that a bitumen feedstock subjected to mild thermal treatment, at 300° C. for 2 hours, followed by solvent deasphalting at 100° C. with a pentane solvent, would require an addition of about 4 vol % of diluent to reach a viscosity of approximately 350 cSt.

Thus, the theoretical combined effect of the mild thermal treatment at low temperatures followed by solvent deasphalting could result in a decrease in the amount of diluent required to meet the pipeline viscosity specification from 32 vol % to 4 vol %.

Subjecting a bitumen feedstock to the above conditions, i.e., mild thermal treatment at 300° C. for 2 hours followed by deasphalting at 100° C. with pentane, is therefore expected to produce a thermally treated bitumen stream that would not require any additional processing to reduce its olefin content.

Cold Lake Bitumen Tests

Thermal Treatment

Mild thermal treatment of Cold Lake bitumen was performed at a temperature of 300° C., under 4 MPa initial nitrogen pressure and for a duration of 4 hours. The reaction was conducted in a 10 mL batch reactor, with no release of gas during the reaction or agitation of the reactor. The viscosity was reduced by two orders of magnitude. The olefin content of the thermally treated bitumen stream was below 1 wt % 1-decene equivalent as determined by 1H NMR analysis. A comparison of the properties of the Cold Lake bitumen feed and of the resulting thermally treated bitumen stream is shown in Table 1 below:

TABLE 1

| Property | Cold Lake bitumen feed | Thermal treatment at 300° C. for 4 hours |
|---|---|---|
| Viscosity @ 40° C. (Pa · s) | 88 ± 1 | 0.4 ± 0.3 |
| Olefin content (wt % 1-decene) | 0.02 ± 0.01 | 0.7 ± 0.6 |

Comparison of the Sequence "Thermal Treatment-Solvent Deasphalting" Vs. The Sequence "Solvent Deasphalting-Thermal Treatment"

In an exemplified implementation, two processing units were combined, i.e., a visbreaking (VB) unit for the mild thermal treatment of bitumen and a solvent deasphalting (SDA) unit using pentane as a deasphalting solvent to reject an asphaltene-enriched stream.

VB tests were conducted at 380° C. for 85 minutes using Cold Lake bitumen to ensure operation just below the severity required for incipient coke formation. Thus, no coke was formed. This also ensured a high level of hydrogen transfer, i.e., the liquid phase transfer of hydrogen from the heavy fraction to the light fraction, to maximize the recovery of hydrogen from the heavy fraction. The results for the sequence VB-SDA, as well as the reverse sequence, SDA-VB at the same conditions, are discussed below.

Referring to Table 2, the product quality from the sequence VB-SDA was considered to present enhanced characteristics compared to the product quality obtained from the reverse SDA-VB. Specifically, the product of VB-SDA had a higher hydrogen-to-carbon (H:C) ratio than the product of SDA-VB, i.e., 1.5 vs 1.3. This information is further confirmed by $^1$H NMR, where a higher percentage of aliphatic hydrogens was observed for the VB-SDA compared to the SDA-VB sequence. Moreover, the VB-SDA product was likely more stable, since it contained no asphaltenes, as they were removed through the SDA step. For instance, about 13% of asphaltenes was observed in the product obtained from a SDA-VB sequence.

TABLE 2

| | x | s |
|---|---|---|
| Visbreaking followed by solvent deasphalting (VB-SDA) | | |
| Material balance (wt %) | | |
| liquids | 96.2 | 0.3 |
| gases | 2.5 | 0.2 |
| coke | 1.3 | 0.1 |
| Σ | 100 | |
| C5 precipitated asphaltenes (wt %) | | |
| precipitated by SDA step | 17.7 | 2.7 |
| Calculated liquid yield (wt %) | 79.2 | |

TABLE 2-continued

| | x | s |
|---|---|---|
| Product characterization | | |
| density at 30° C. (kg/m3) | 976.9 | 0.8 |
| refractive index at 30° C. [nD] | 1.5547 | 0.0005 |
| viscosity at 60° C. (Pa · s) | 0.25 | 0.09 |
| microcarbon residue (wt %) | 7.2 | 0.7 |
| H NMR aliphatic hydrogen (%) | 91.8 | 2.9 |
| Product elemental analysis (wt %) | | |
| C | 84.5 | 0.0 |
| H | 10.6 | 0.1 |
| N | 0.4 | 0.0 |
| S | 3.6 | 0.1 |
| O (by difference) | 0.9 | |
| H/C calculated | 1.50 | |
| Solvent Deasphalting Followed by Visbreaking (SDA-VB) | | |
| Material balance (wt %) | | |
| liquids | 97.3 | 0.1 |
| gases | 2.1 | 0.2 |
| coke | 0.6 | 0.3 |
| Σ | 100 | |
| C5 precipitated asphaltenes (wt %) | | |
| precipitated by SDA step | 16.6 | 0.7 |
| in product after visbreaking | 13.2 | 0.7 |
| Calculated liquid yield (wt %) | 81.1 | |
| Product characterization | | |
| density at 30° C. (kg/m3) | 980.7 | 1.3 |
| refractive index at 30° C. [nD] | 1.5932 | 0.0003 |
| viscosity at 60° C. (Pa · s) | 0.13 | 0.02 |
| microcarbon residue (wt %) | 11.1 | 1.0 |
| H NMR aliphatic hydrogen (%) | 73.0 | 2.6 |
| Product elemental analysis (wt %) | | |
| C | 85.8 | 0.2 |
| H | 9.6 | 0.0 |
| N | 0.5 | 0.0 |
| S | 3.7 | 0.0 |
| O (by difference) | 0.5 | |
| H/C calculated | 1.33 | |

The microcarbon residue, a measure of the coking propensity of the oil, was lower for the VB-SDA product than for the SDA-VB product (7.2 wt % vs. 11.1 wt %). However, the volume yield was lower with the VB-SDA product than with the SDA-VB product (79 vol % vs. 81 vol %), as some of the asphaltenes produced during the thermal treatment were also rejected by the subsequent SDA step.

The viscosity for both the VB-SDA and the SDA-VB products was found to be about 3 to 4 orders of magnitude lower than the raw bitumen feedstock, and below typical pipeline viscosity specifications.

In another exemplified experimentation and referring to Table 3, the product from a sequence [thermal treatment—solvent deasphalting] as described herein had a H:C ratio of 1.46 for the vacuum topped bitumen (VTB) and of 1.49 for the whole bitumen. In comparison, a product from a sequence [solvent deasphalting—thermal treatment], as described herein had a H:C ratio of 1.42 for the VTB and of 1.47 for whole bitumen. These results were obtained with a single pass process.

TABLE 3

| | | SDA-Thermal treatment | | | Thermal treatment-SDA | | |
|---|---|---|---|---|---|---|---|
| | Sample | Conversion (%) | ERT (seconds) | H:C | Conversion (%) | ERT (seconds) | H:C |
| VTB | 1 | 43.5 | ~1250 | 1.42 | | | |
| WB | 2 | 44.0 | ~3000 | 1.47 | | | |
| VTB | 3 | | | | 40.0 | ~1700 | 1.46 |
| WB | 4 | | | | 41.5 | ~1800 | 1.49 |

Athabasca Bitumen Tests

Thermal Treatment

Thermal treatment of an Athabasca bitumen feedstock from an in-situ SAGD facility was performed at 340° C., under 1.5 MPa initial nitrogen pressure and for a duration of 1 hour. The reaction was conducted in a 2 L batch reactor, with no release of gas during reaction and stirring at 220 rpm. The viscosity was reduced by half and no detectable increase in olefin content was observed.

A comparison of the properties of the Athabasca bitumen feedstock and of the resulting thermally treated bitumen stream is shown in Table 4 below:

TABLE 4

| Property | Athabasca bitumen feed | Thermal treatment at 340° C. for 1 hour |
|---|---|---|
| Viscosity @ 15.6° C. (Pa · s) | 1390 ± 20 | 767 ± 8 |
| Olefin content (wt % 1-decene) | ~0.00 | ~0.00 |

Thermal Treatment Followed by Solvent Deasphalting

The following example illustrates the overall process that included thermal treatment at mild conditions with a light hydrocarbon co-feed, followed by solvent deasphalting at a solvent-to-bitumen ratio of 5:1. In this example, an Athabasca bitumen feedstock from an in-situ SAGD facility was thermally treated at a temperature of 375° C., at a pressure of 2 MPa for a duration of 2 hours. Butane was co-fed to the thermal treatment vessel and the solubility of butane in the bitumen at the reaction conditions was estimated to be ~0.7 wt %. Following the mild thermal treatment step, the thermally treated bitumen stream was solvent deasphalted with n-pentane.

The results of the experiment are shown in Table 5 below:

TABLE 5

| Property | Athabasca bitumen feed | Thermal treatment at 375° C. with butane for 2 hours followed by solvent deasphalting |
|---|---|---|
| Viscosity @ 15.6° C. (Pa · s) | 1390 ± 20 | 0.46 |
| Density @ 15.6° C. (kg/m$^3$) | 1013.5 ± 0.2 | 959.2 |
| Degree API gravity | 8.01 ± 0.04 | 15.9 |
| H:C ratio | 1.50 | 1.55 |
| Olefin content (wt % 1-decene) | ~0.00 | 0.17 |

These results show that the hydrogen-to-carbon ratio of the Athabasca bitumen feedstock following the mild thermal treatment and solvent deasphalting at the conditions mentioned above was increased from 1.50 to 1.55 while the olefin content was less than 1 wt % of 1-decene equivalent.

The density of the treated bitumen was also very close to the pipeline specification of 940 kg/m$^3$. The viscosity of the thermally treated bitumen stream was also reduced by three orders of magnitude. In summary, with a typical diluent, e.g. CRW (density of 697 kg/m$^3$) all North American pipeline specifications will be met with about 7.5 vol % diluent.

Asphaltenes Hydrogen:Carbon Ratio

The H:C ratio of asphaltenes obtained after thermal treatment under various severity conditions was evaluated. As shown in Table 6, the H:C molar ratio was lower for asphaltenes from the thermally treated bitumen than that of the asphaltenes from bitumen which has not undergone thermal treatment.

TABLE 6

| Feed | ERT (s) | Asphaltene H:C Ratio (mol basis) |
|---|---|---|
| Whole Bitumen | N/A | 1.17 |
| Product - test runs: | | |
| Test 1 | 660 | 0.95 |
| Test 2 | 918 | 0.92 |
| Test 3 | 1225 | 0.89 |

This result indirectly evidences that a transfer of hydrogen from the heavy fraction to the light/lighter fraction of the bitumen occurs during thermal treatment according to the present process.

Comparison Between Single Pass Partial Upgrading Treatment and Partial Upgrading Treatment with a Recycle Feed The following example is a comparison between characteristics of a partially upgraded bitumen product obtained by a process including a solvent deasphalting step followed by a thermal treatment step either in a single-pass or in a recycling mode. In both cases, the composition of the thermally treated asphaltene-reduced stream obtained after the asphaltene-reduced stream was subjected to the thermal treatment was evaluated and the proportions in vol. % of the various fractions was determined. These proportions are indicated in Table 7, i.e., a naphtha stream, a distillate stream, a gasoil stream and a vacuum residue stream.

For the process including the recycling step, the vacuum residue stream obtained following the separation was recycled to form part of the bitumen feedstock, which was subjected once again to the thermal treatment. The recycle was operated continuously for up to 4 hours.

The results show that the product yield was increased from 81.6 vol. % to 82.3 vol. % when a recycling step is performed. In addition, the results show that proportion of the vacuum residue fraction, that was initially 62 vol. % for the bitumen feedstock, was reduced to 24.5 vol. % following the single-pass process, and further to 15.1 vol. % when the recycling step was performed.

TABLE 7

| Case Description | | Bitumen | SDA & Thermal treatment without recycle | SDA & Thermal treatment with recycle |
|---|---|---|---|---|
| Product Yield | Vol % | 0.0 | 81.6 | 82.3 |
| Added HT Diluent | Vol % | 0.0 | 5% | 0 |
| Product Density | API | 8.2 | 21 | 21.5 |

TABLE 7-continued

| Case Description | | Bitumen | SDA & Thermal treatment without recycle | SDA & Thermal treatment with recycle |
|---|---|---|---|---|
| Product Blend | | | | |
| Naphtha (C5 - 180° C.) | Vol % | 0.0 | 9.7 | 7.5 |
| Distillate (180° C.-350° C.) | Vol % | 16.5 | 25.4 | 29.0 |
| Gasoil (350° C.-520° C.) | Vol % | 21.2 | 40.5 | 48.5 |
| Vacuum Residue (+520° C.) | Vol % | 62.0 | 24.5 | 15.1 |
| Total | Vol % | 100 | 100 | 100 |

The invention claimed is:

1. A process for treating a hydrocarbon feedstock comprising a liquid phase that includes at least a heavy fraction, the process comprising the steps of:

subjecting the hydrocarbon feedstock to a thermal treatment at about or below incipient coking conditions, comprising:

heating the hydrocarbon feedstock at a temperature from about 200° C. to about 475° C. at a pressure of between about 50 psi and about 1500 psi and for a residence time of up to 300 minutes, a light fraction and a lighter fraction being generated during the thermal treatment, to produce a thermally treated hydrocarbon stream comprising a treated liquid phase and a gas phase;

wherein the temperature, pressure and residence time of the thermal treatment are selected to achieve retaining at least a portion of the lighter fraction in the liquid phase to allow a transfer of hydrogen from the heavy fraction to the light fraction directly in the liquid phase.

2. The process of claim 1, further comprising:

separating the gas phase of the thermally treated hydrocarbon stream from the treated liquid phase thereof; and deasphalting the treated liquid phase of the thermally treated hydrocarbon stream or a fraction thereof, comprising contacting the treated liquid phase with a deasphalting solvent to obtain an asphaltene-reduced stream and an asphaltene-enriched stream.

3. The process of claim 2, further comprising:

processing the asphaltene-enriched stream to produce an asphaltene-derived material, wherein the processing comprises recovering at least a portion of the deasphalting solvent, at least a portion of the lighter fraction, at least a portion of the light fraction from the asphaltene-enriched stream, or a combination thereof.

4. The process of claim 1, further comprising:

separating the thermally treated hydrocarbon stream to obtain a thermally treated light fraction and a thermally treated residue fraction; and deasphalting the thermally treated residue fraction or a fraction thereof, comprising contacting the thermally treated residue fraction with a deasphalting solvent to obtain an asphaltene-reduced stream and an asphaltene-enriched stream.

5. The process of claim 4, further comprising:

recycling a portion of the asphaltene-reduced stream to form part of the hydrocarbon feedstock that is subjected to the thermal treatment.

6. The process of claim 1, wherein the hydrocarbon feedstock subjected to the thermal treatment comprises an asphaltene-reduced stream derived from a solvent deasphalting step.

7. The process of claim 1, further comprising:

separating the thermally treated hydrocarbon stream to obtain a thermally treated light fraction and a thermally treated residue fraction;

wherein the hydrocarbon feedstock comprises an asphaltene-reduced stream derived from a solvent deasphalting step; and wherein the thermally treated residue fraction or a fraction thereof is recycled to be subjected to the solvent deasphalting step.

8. The process of claim 1, further comprising:

monitoring the hydrocarbon feedstock, comprising determining at least one property of the hydrocarbon feedstock; and adjusting composition of the hydrocarbon feedstock according to the at least one property of the hydrocarbon feedstock prior to subjecting the hydrocarbon feedstock to the thermal treatment.

9. The process of claim 8, wherein the at least one property is a proportion of at least one of the heavy fraction, the light fraction and the lighter fraction in the hydrocarbon feedstock, a composition characteristic of the hydrocarbon feedstock, a viscosity of the hydrocarbon feedstock or a density of the hydrocarbon feedstock, or a combination thereof.

10. The process of claim 8, wherein adjusting composition of the hydrocarbon feedstock comprises increasing the proportion of the heavy fraction in the hydrocarbon feedstock.

11. The process of claim 8, wherein adjusting composition of the hydrocarbon feedstock comprises blending multiple hydrocarbon streams having different compositions together.

12. The process of claim 1, wherein the thermal treatment further comprises:

feeding the hydrocarbon feedstock to a thermal treatment vessel;

heating the liquid phase of the hydrocarbon feedstock in the thermal treatment vessel to produce the thermally treated hydrocarbon stream; and withdrawing the thermally treated hydrocarbon stream from the thermal treatment vessel as a single stream from a product outlet, the single stream comprising the treated liquid phase and the gas phase.

13. The process of claim 1, wherein the hydrocarbon feedstock comprises a bitumen feedstock.

14. The process of claim 13, wherein the bitumen feedstock is a diluent-depleted bitumen stream that is obtained from a bitumen froth treatment operation or from an in situ recovery operation, and that has not been subjected to distillation or fractionation to remove light hydrocarbon components therefrom.

15. The process of claim 1, wherein the at least a portion of the lighter fraction retained in the liquid phase further allows a transfer of hydrogen from at least one of the heavy and the light fraction to the lighter fraction directly in the liquid phase.

16. The process of claim 1, wherein the at least a portion of the lighter fraction is substantially all of the lighter fraction.

17. The process of claim 1, wherein subjecting the hydrocarbon feedstock to the thermal treatment comprises adding an external source of hydrogen to the hydrocarbon feedstock.

18. The process of claim 1, wherein subjecting the hydrocarbon feedstock to the thermal treatment comprises adding a hydrogen transfer agent to the hydrocarbon feedstock.

19. The process of claim 1, wherein no external source of hydrogen and no hydrogen transfer agent are added to the hydrocarbon feedstock for the thermal treatment.

20. The process of claim 1, wherein the gas phase comprises non-condensable gas.

21. The process of claim 1, wherein the gas phase represents less than 10 wt % of the thermally treated hydrocarbon stream.

22. The process of claim 1, wherein the thermally treated hydrocarbon stream comprises an olefin content of less than 5.0 wt % on a 1-decene equivalent basis.

23. The process of claim 1, wherein the temperature at which is operated the thermal treatment is between about 250° C. and about 400° C.

24. The process of claim 1, wherein the temperature at which is operated the thermal treatment is between about 250° C. and about 425° C.

25. The process of claim 1, wherein the temperature at which is operated the thermal treatment is about 380° C. or less.

26. The process of claim 1, wherein the temperature at which is operated the thermal treatment is about 340° C. or less.

27. The process of claim 1, wherein the temperature at which is operated the thermal treatment is about 300° C. or less.

28. The process of claim 1, wherein the pressure at which is operated the thermal treatment is about 580 psi or less.

29. The process of claim 1, wherein the pressure at which is operated the thermal treatment is between about 215 psi and about 715 psi.

30. A process for treating a bitumen feedstock, comprising:

subjecting the bitumen feedstock to a thermal treatment comprising:

heating the bitumen feedstock at a temperature from about 200° C. to about 475° C. and at a pressure of between about 50 psi and about 1500 psi to produce a thermally treated bitumen comprising an olefin content of less than 5.0 wt % on a 1-decene equivalent basis;

separating the thermally treated bitumen to obtain a thermally treated light fraction and a thermally treated residue fraction;

subjecting the thermally treated residue fraction to a solvent deasphalting treatment, comprising contacting the thermally treated residue fraction with a deasphalting solvent to obtain an asphaltene-reduced stream and an asphaltene-enriched stream; and recycling a portion of the asphaltene-reduced stream to form part of the bitumen feedstock that is subjected to the thermal treatment.

31. The process of claim 30, wherein the thermal treatment is performed for a residence time of up to 300 minutes.

32. The process of claim 31, wherein the temperature, the pressure and the residence time of the thermal treatment are selected to operate the thermal treatment at or below incipient coke formation.

33. A process for treating a bitumen feedstock, the process comprising the steps of:

subjecting the bitumen feedstock to a solvent deasphalting treatment to produce an asphaltene-reduced stream and an asphaltene-enriched stream;

subjecting the asphaltene-reduced stream to a thermal treatment at about or below incipient coking conditions, the thermal treatment comprising:

heating the asphaltene-reduced stream at a temperature from about 200° C. to about 475° C. and at a pressure of between about 50 psi and about 1500 psi to produce a thermally treated asphaltene-reduced stream; and separating the thermally treated asphaltene-reduced stream to obtain a thermally treated light stream and a thermally treated residue stream; and recycling a portion of the thermally treated residue stream to form part of the bitumen feedstock that is subjected to the solvent deasphalting treatment.

34. The process of claim 33, wherein the thermal treatment is performed for a residence time of up to 300 minutes.

35. The process of claim 34, wherein the temperature, the pressure and the residence time of the thermal treatment are selected to operate the thermal treatment at or below incipient coke formation.

36. A system for treating a bitumen feedstock comprising a liquid phase that includes a heavy fraction, a light fraction and a lighter fraction, the system comprising:

a thermal treatment vessel configured to receive the bitumen feedstock and operable to produce a thermally treated bitumen stream comprising a liquid phase and a gas phase, wherein the thermal treatment is configured such that at least a portion of the lighter fraction is retained in the liquid phase to allow a transfer of hydrogen from the heavy fraction to the light and the lighter fraction directly in the liquid phase.

* * * * *